US010479090B2

(12) United States Patent
Danzuka et al.

(10) Patent No.: US 10,479,090 B2
(45) Date of Patent: Nov. 19, 2019

(54) INKJET RECORDING APPARATUS AND INK DISCHARGE METHOD

(71) Applicant: CANON KABUSHIKI KAISHA, Tokyo (JP)

(72) Inventors: Toshimitsu Danzuka, Tokyo (JP); Taku Yokozawa, Yokohama (JP); Masataka Kato, Yokohama (JP); Akiko Aichi, Tokyo (JP); Shin Genta, Yokohama (JP); Kazuki Narumi, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/913,760

(22) Filed: Mar. 6, 2018

(65) Prior Publication Data

US 2018/0257380 A1 Sep. 13, 2018

(30) Foreign Application Priority Data

Mar. 10, 2017 (JP) ..... 2017-046507

(51) Int. Cl.

| | |
|---|---|
| ***B41J 2/17*** | (2006.01) |
| ***B41J 2/045*** | (2006.01) |
| ***B41J 2/165*** | (2006.01) |
| ***B41J 2/175*** | (2006.01) |
| ***B41J 29/38*** | (2006.01) |

(52) U.S. Cl.

CPC ..... *B41J 2/1707* (2013.01); *B41J 2/04536* (2013.01); *B41J 2/16508* (2013.01); *B41J 2/16517* (2013.01); *B41J 2/16523* (2013.01); *B41J 2/16532* (2013.01); *B41J 2/175* (2013.01); *B41J 2/17523* (2013.01); *B41J 2/17566* (2013.01); *B41J 29/38* (2013.01); *B41J 2002/16573* (2013.01); *B41J 2002/17579* (2013.01)

(58) Field of Classification Search

CPC ..... B41J 2/1707; B41J 2/17566

See application file for complete search history.

(56) References Cited

U.S. PATENT DOCUMENTS

| | | | | |
|---|---|---|---|---|
| 2010/0245436 | A1* | 9/2010 | Nishida | B41J 2/1652 347/14 |
| 2016/0052276 | A1* | 2/2016 | Tenkawa | B41J 2/16508 347/7 |
| 2017/0087850 | A1* | 3/2017 | Kerpe | B41J 2/175 |
| 2017/0361620 | A1* | 12/2017 | Sawada | B41J 2/17566 |

FOREIGN PATENT DOCUMENTS

JP 2014-24189 A 2/2014

* cited by examiner

*Primary Examiner* — Julian D Huffman

(74) *Attorney, Agent, or Firm* — Canon U.S.A., Inc. IP Division

(57) ABSTRACT

An inkjet recording apparatus includes a recording unit, a first ink storage unit, a second ink storage unit, a discharge unit, a first detection unit configured to detect that an amount of the ink stored in the first ink storage unit is below a first predetermined amount, and a second detection unit configured to detect that an amount of the ink stored in the second ink storage unit is below a second predetermined amount. The inkjet recording apparatus further includes a control unit configured to control the discharge operation after the detection by the first detection unit and the detection by the second detection unit based on a detection timing of the first detection unit and a detection timing of the second detection unit.

8 Claims, 13 Drawing Sheets

FIG.5

500

| Moff/Poff | Nth |
|---|---|
| Moff = 0 or Poff = 0 | 9 |
| \| Moff-Poff \| = 0 | 5 |
| \| Moff-Poff \| = 1 | 5 |
| \| Moff-Poff \| = 2 | 6 |
| \| Moff-Poff \| = 3 | 7 |
| \| Moff-Poff \| = 4 | 8 |
| \| Moff-Poff \| ≥ 5 | 9 |

FIG.12

1200

| Xoff/Yoff/Zoff | | Qth |
|---|---|---|
| Zoff = 0 | | 7 |
| Yoff = 0 | | 7 |
| Xoff = 0 | \| Yoff-Zoff \| = 0 | 4 |
| | \| Yoff-Zoff \| = 1 | 4 |
| | \| Yoff-Zoff \| = 2 | 5 |
| | \| Yoff-Zoff \| ≥ 3 | 7 |
| \| Xoff-Yoff \| = 0 | \| Yoff-Zoff \| = 0 | 3 |
| | \| Yoff-Zoff \| = 1 | 3 |
| | \| Yoff-Zoff \| = 2 | 4 |
| | \| Yoff-Zoff \| ≥ 3 | 7 |
| \| Xoff-Yoff \| = 1 | \| Yoff-Zoff \| = 0 | 3 |
| | \| Yoff-Zoff \| = 1 | 3 |
| | \| Yoff-Zoff \| = 2 | 5 |
| | \| Yoff-Zoff \| ≥ 3 | 7 |
| \| Xoff-Yoff \| = 2 | \| Yoff-Zoff \| = 0 | 3 |
| | \| Yoff-Zoff \| = 1 | 4 |
| | \| Yoff-Zoff \| = 2 | 5 |
| | \| Yoff-Zoff \| ≥ 3 | 7 |
| \| Xoff-Yoff \| ≥ 3 | \| Yoff-Zoff \| = 0 | 4 |
| | \| Yoff-Zoff \| = 1 | 4 |
| | \| Yoff-Zoff \| = 2 | 5 |
| | \| Yoff-Zoff \| ≥ 3 | 7 |

INKJET RECORDING APPARATUS AND INK DISCHARGE METHOD

BACKGROUND

Field of the Disclosure

The present disclosure generally relates to an inkjet recording apparatus and an ink discharge method.

Description of the Related Art

In recent years, a demand for an increase in an amount of ink prepared in advance in an inkjet recording apparatus has been becoming increasingly strong. Thus, an increasing number of inkjet recording apparatuses have been becoming configured in such a manner that an ink ejection port array provided to a recording head mounted on, for example, a carriage and an ink storage unit disposed fixedly relative to the apparatus are connected to each other via an ink supply path, such as a tube.

Among such inkjet recording apparatuses, there are also many inkjet recording apparatuses using a hydraulic head difference method that maintains a negative pressure in the recording head by an atmosphere communication port to the ink storage unit being provided and the intake storage unit being set in such a manner that an ink liquid surface in the ink storage unit is located at a lower position in the direction of gravitational force than the ink ejection port. When the inkjet recording apparatuses using the hydraulic head difference method working in such a manner are largely tilted, this may lead to generation of a positive pressure or a negative pressure having a large absolute value in the recording head, raising a possibility of destruction of a meniscus formed at the ink ejection port. The destruction of the meniscus at the ink ejection port may result in a leak of the ink out of the ink ejection port or the atmosphere communication port of the ink storage unit.

Japanese Patent Application Laid-Open No. 2014-24189 discusses such a configuration that the ink in the apparatus is discharged by a substantially entire amount at the time of transportation during which the inkjet recording apparatus may be largely tilted.

However, according to the method discussed in Japanese Patent Application Laid-Open No. 2014-24189, an operator should visually confirm that the ink in the inkjet recording apparatus is sucked and discharged by the substantially entire amount. However, the visual confirmation requires a detailed knowledge regarding an ink flow path. Therefore, this method has such a remaining problem that the operator should substantially be a trained person such as a serviceperson. Further, this method has such a remaining problem that sucking and discharging the ink often requires a long time.

SUMMARY

Aspects of the present disclosure are generally related to providing a technique that enables the ink in the apparatus to be discharged without requiring the trained person, such as the serviceperson, and the long time.

Another object of the present disclosure is to provide an inkjet recording apparatus including a recording unit including a first ink ejection port array and a second ink ejection port array, a first ink storage unit configured to store ink to be supplied to the first ink ejection port array, a second ink storage unit configured to store ink to be supplied to the second ink ejection port array, a discharge unit configured to perform a discharge operation of discharging at least any one of the ink and air from the first ink ejection port array and the second ink ejection port array, a first detection unit configured to detect that an amount of the ink stored in the first ink storage unit falls below a first predetermined amount, a second detection unit configured to detect that an amount of the ink stored in the second ink ejection port array falls below a second predetermined amount, and a control unit configured to control the discharge operation after the detection by the first detection unit and the detection by the second detection unit based on a detection timing of the first detection unit and a detection timing of the second detection unit.

Further features of the present disclosure will become apparent from the following description of exemplary embodiments with reference to the attached drawings.

BRIEF DESCRIPTION OF THE DRAWINGS

FIG. 5 illustrates an example of a table used in the ink discharge sequence according to the first exemplary embodiment.

FIG. 12 illustrates an example of a table used in the ink discharge sequence according to the third exemplary embodiment.

DESCRIPTION OF THE EMBODIMENTS

In the following description, exemplary embodiments for implementing aspects of the present disclosure will be described with reference to the drawings.

[Configuration of Apparatus]

Figure 1:
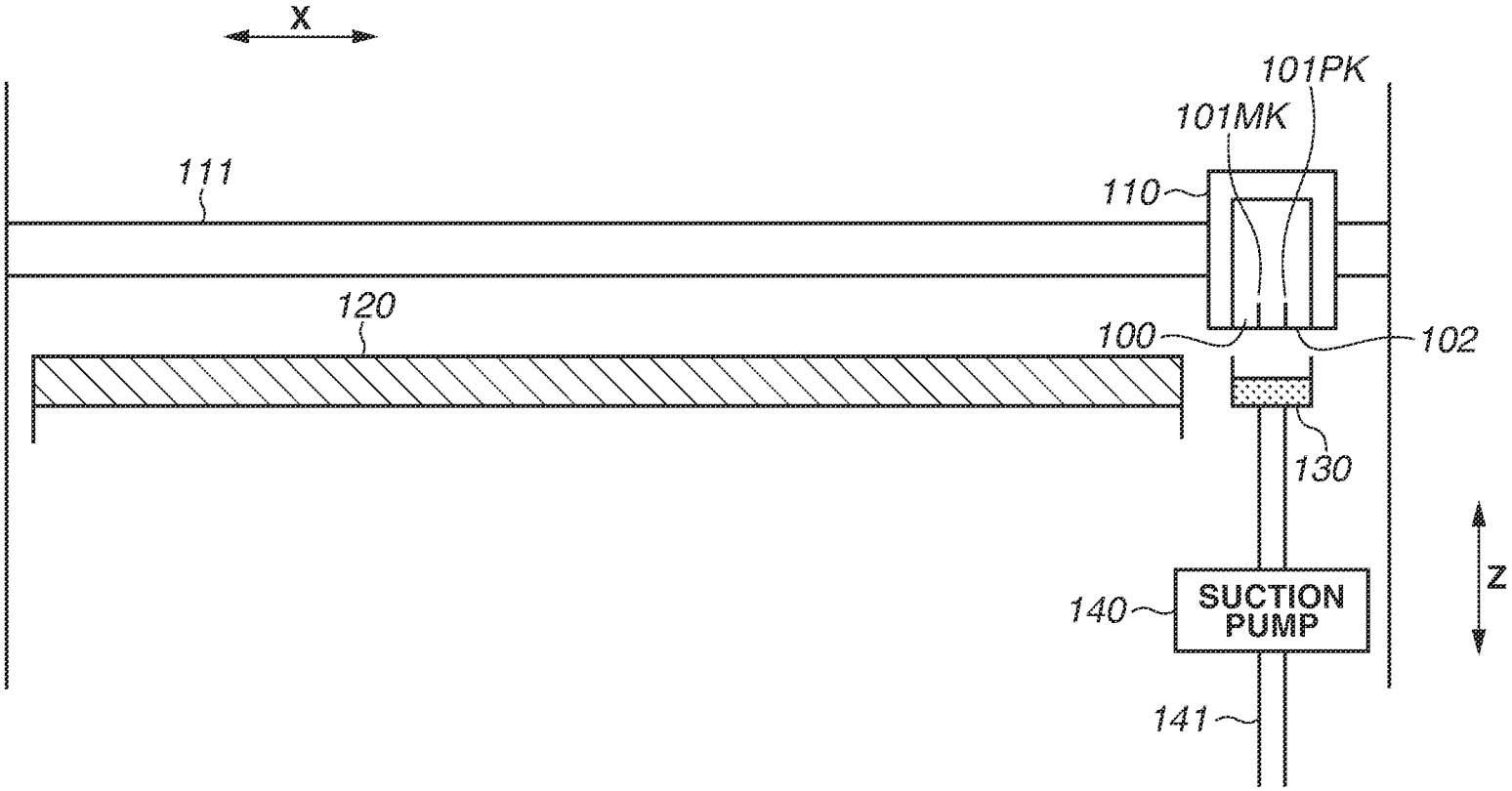
FIG. 1 is a schematic cross-sectional view illustrating one example of an inkjet recording apparatus according to a first exemplary embodiment.

A first exemplary embodiment will be described below in detail. FIG. 1 illustrates a schematic cross-sectional view (main portions) of one example of an inkjet recording apparatus according to an exemplary embodiment of the present disclosure. In FIG. 1, an X direction is defined to be a direction in which a recording head 100 (a carriage 110) is movable, and a Z direction is defined to be a direction orthogonal to the X direction along a plane of FIG. 1. Further, a Y direction is defined to be a direction perpendicular to the plane of FIG. 1.

The recording head 100 includes ink ejection port arrays 101MK and 101PK that eject ink (a recording material), on an ink ejection port surface 102. The ink ejection port array 101MK is an ink ejection port array that ejects matte black ink (MK), and the ink ejection port array 101PK is an ink ejection port array that ejects photo black ink (PK). In each of the ink ejection port arrays 101MK and 101PK, 1280 ink ejection ports are arrayed in such a manner that respective intervals are 1200 dots per inch (dpi) in the Y direction. Further, an electrothermal converter (not illustrated) is provided inside each of the ink ejection ports. By applying an electric signal based on a driving signal to this electrothermal converter, the inkjet recording apparatus generates an air bubble in the ink, thereby ejecting the ink from the ink ejection port with the aid of a pressure of this air bubble. In the present example, a description will be provided of two types of black ink, namely, the photo black ink excellently usable to print an image and the matte black ink that is little glossy black ink as an example of the ink (the recording material), but this is not intended to limit the ink to this color.

Further, the recording head 100 is mounted on the carriage 110, which is guided by a guide shaft 111 and reciprocates in the X direction according to a rotation of a carriage motor (not illustrated). The carriage 110 reciprocates in the X direction while a recording medium (hereinafter also referred to as a medium) intermittently conveyed in the Y direction on a platen 120 according to an intermittent rotation of a conveyance motor (not illustrated) is stopped. The ink is ejected from the ink ejection ports of the recording head 100 toward the medium during this reciprocation, by which an image or the like is recorded. Recording onto one medium is completed by repeating the intermittent conveyance of the medium and the ejection of the ink during the reciprocation of the carriage 110 the number of times corresponding to one medium.

A cap 130 is a cap for preventing or reducing vaporization of a solvent in the ink from the ink ejection ports, and reciprocates between a capping position and a separation position in the Z direction in FIG. 1 through a known method. FIG. 1 illustrates the separation position that is a state in which the cap 130 and the ink ejection ports of the recording head 100 are separated from each other. When being located at the capping position, the cap 130 is disposed so as to close the ink ejection port surface 102. The cap 130 is connected to a suction pump 140 via a pump tube 141. Then, the cap 130 is configured in such a manner that the ink can be sucked and discharged from the ink ejection port arrays 101Mk and 101PK by the suction pump 140 when the cap 130 is located at the capping position being driven. The cap 130 is provided with an ink absorber, and the ink sucked and discharged by the driving of the suction pump 140 is contained in a maintenance cartridge (not illustrated).

Figure 2:
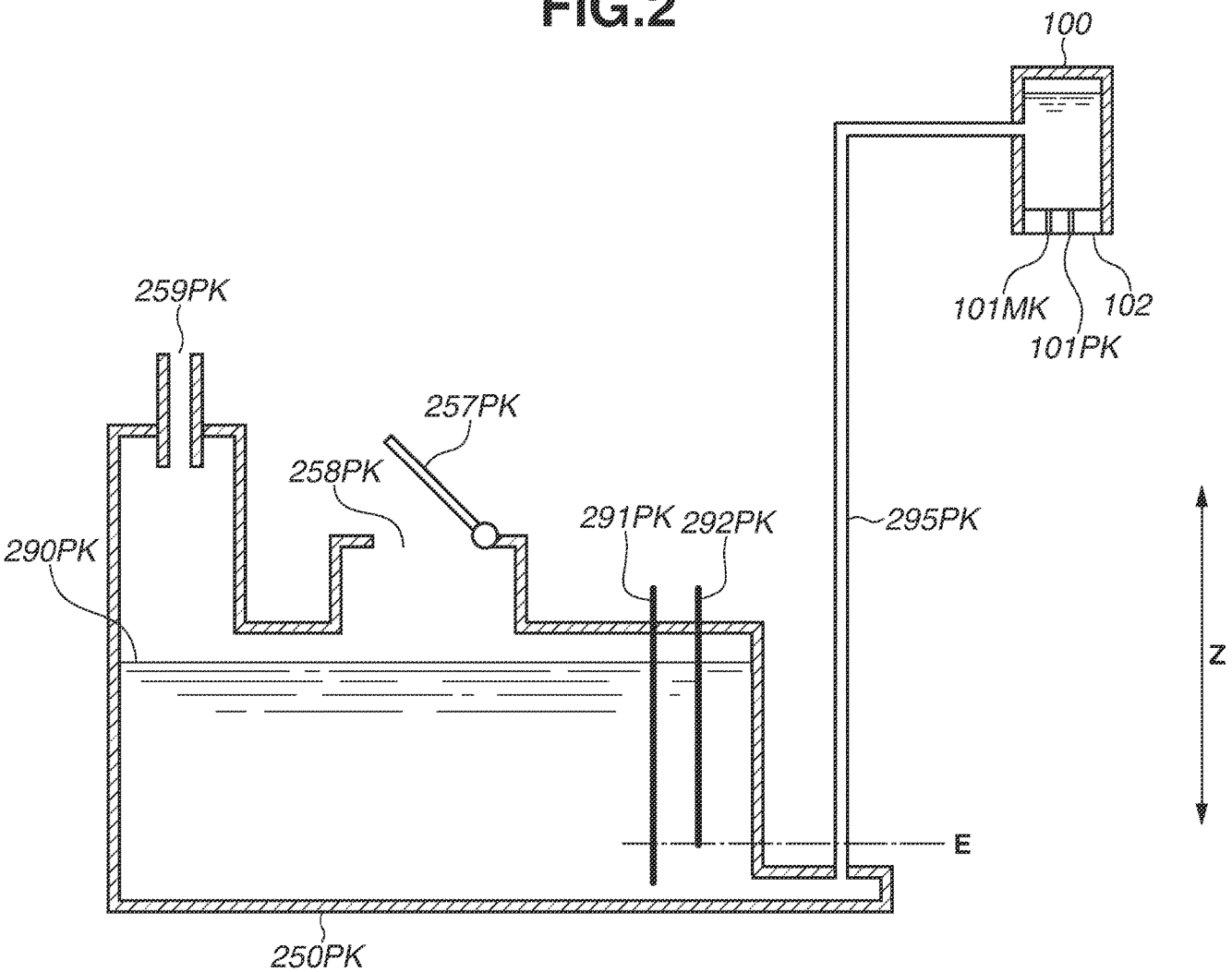
FIG. 2 is a schematic cross-sectional view illustrating one example of an ink supply system according to the first exemplary embodiment.

Next, an ink supply system of the inkjet recording apparatus will be described with reference to FIG. 2. FIG. 2 is a schematic cross-sectional view (main portions) illustrating one example of the ink supply system according to the exemplary embodiment. In the present example, the ink supply system will be described with use of an example corresponding to the photo black ink (PK), and is assumed to also have a similar configuration regarding the other ink.

The ink ejection port array 101PK of the recording head 100 is in communication with an ink tank 250PK via a supply tube 295 PK. The ink tank 250PK stores the photo black ink therein and includes an atmosphere communication port 259PK. As the photo black ink is being consumed by, for example, being ejected from the ink ejection port array 101PK for the recording, an ink liquid surface 290PK in the ink tank 250PK is being lowered.

The ink tank 250PK is provided with two electrodes 291PK and 292PK functioning as a detection unit. The inkjet recording apparatus detects whether the ink liquid surface 290PK in the ink tank 250PK is located at a lower position than a position in a vertical direction that is indicated by E in FIG. 2, by detecting a voltage value when a micro current is applied to between these two electrodes 291PK and 292PK. More specifically, when the micro current is applied to between the two electrodes 291PK and 292PK in a case where the ink liquid surface 290PK in the ink tank 250PK is located at the same position as or a higher position than the position in the vertical direction that is indicated by E in FIG. 2, the current flows via the ink and therefore a low voltage value is detected at this time. On the other hand, in a case where the ink liquid surface 290PK in the ink tank 250PK is located at a lower position than the position in the vertical direction that is indicated by E in FIG. 2, the current does not flow via the ink and therefore a high voltage value is detected when the micro current is applied.

In this manner, the inkjet recording apparatus can detect whether the ink liquid surface 290PK in the ink tank 250PK is located at a lower position than the position in the vertical direction that is indicated by E in FIG. 2. In other words, this configuration enables the inkjet recording apparatus to detect whether an amount of the ink stored in the ink tank 250PK falls below a predetermined amount. Hereinafter, such a detection operation will also be referred to as ink remainder detection or remainder detection. A detection result will also be referred to as a remainder detection result. Furthermore, a result in the case where the detected voltage value is low will also be referred to as remainder detection ON, and a result in the case where the detected voltage value is high will also be referred to as remainder detection OFF. In addition, the position in the vertical direction that is indicated by E in FIG. 2 will also be referred to as a remainder detection position. In the present exemplary embodiment, the inkjet recording apparatus will be described assuming that an amount of the photo black ink remaining in the ink supply system in communication with the ink ejection port array 101PK is approximately 17 ml when the ink liquid surface 290PK in the ink tank 250PK is located at the remainder detection position.

The inkjet recording apparatus according to the present exemplary embodiment interrupts an operation accompanying ink consumption, such as the recording, and waits until the ink is replenished and the remainder detection result returns to the remainder detection ON if carrying out the ink remainder detection and acquiring the remainder detection OFF as a result thereof. The ink tank 250PK is provided with an ink replenishment port 258PK and an ink replenishment port cover 257PK for replenishing the ink that are used at this time. FIG. 2 illustrates the ink supply system with the ink replenishment port cover 257PK opened.

A position of the ink tank 250PK in the vertical direction and another layout thereof are set in such a manner that the ink liquid surface 290PK in the ink tank 250PK is located at a lower position in the direction of gravitational force than the ink ejection port surface 102 of the recording head 100. Thus, a pressure in the recording head 100 is kept at a negative pressure due to a hydraulic head difference. The position of the ink tank 250PK in the vertical direction and the other layout thereof are set so as to prevent a meniscus formed at the ink ejection ports from being destroyed due to this negative pressure.

Hereinafter, the ink tank 250PK in communication with the ink ejection port array 101PK and an ink tank 250MK in communication with the ink ejection port array 101MK will also be referred to as simply the ink tank 250PK and the ink tank 250MK, respectively. Further, the ink supply system in communication with the ink ejection port array 101PK and the ink supply system in communication with the ink ejection port array 101MK will also be referred to as an ink supply system PK and an ink supply system MK, respectively.

[Control System]

Subsequently, a control system of the inkjet recording apparatus according to the present exemplary embodiment will be described with reference to FIG. 3.

Figure 3:
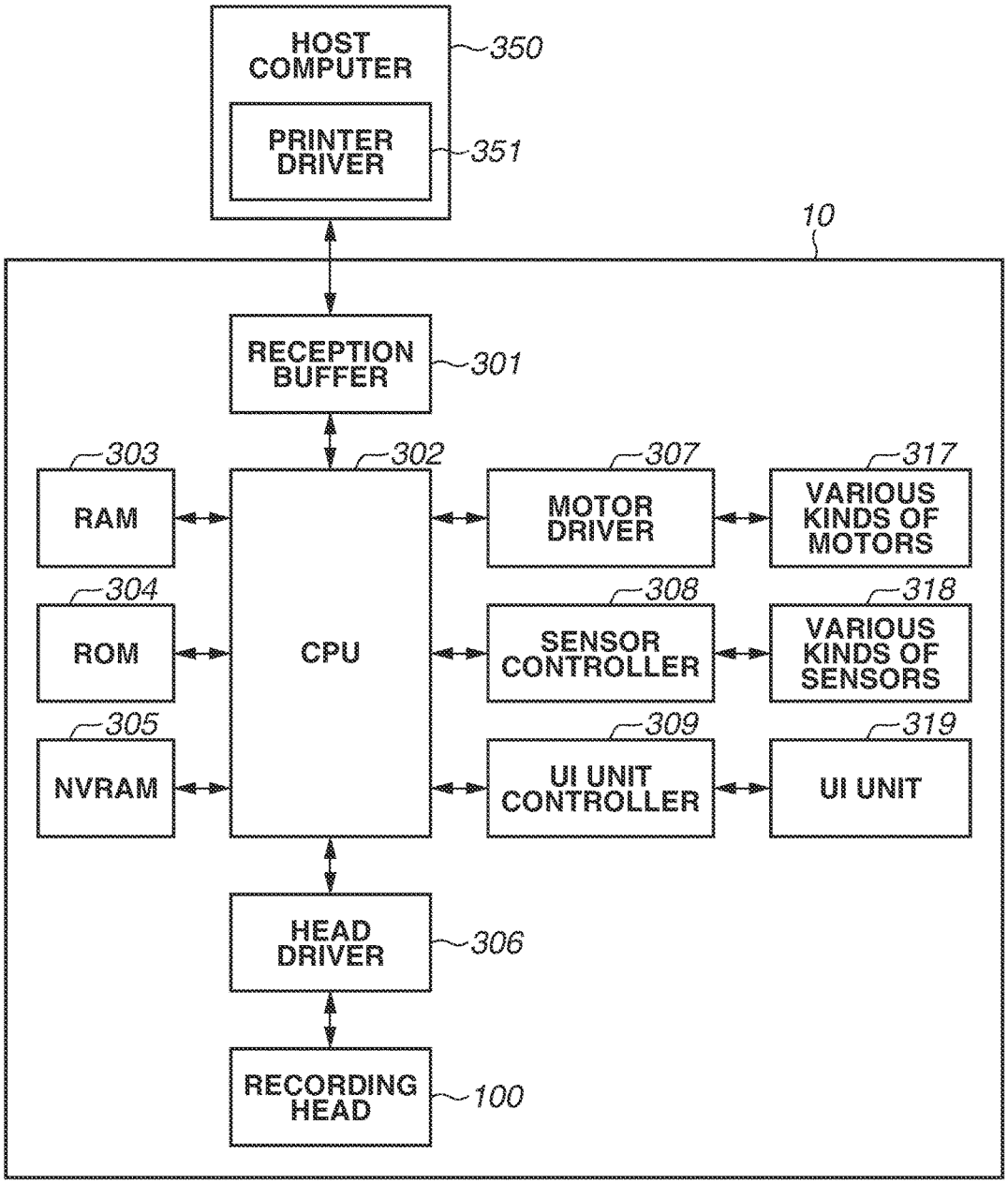
FIG. 3 illustrates one example of a control system of the inkjet recording apparatus according to each of exemplary embodiments.

In FIG. 3, a host computer 350 is an information processing apparatus, such as a personal computer (PC), and is communicably connected to an inkjet recording apparatus 10 according to the present exemplary embodiment via, for example, a Universal Serial Bus (USB) interface. A printer driver 351 corresponds to the inkjet recording apparatus 10 that is stored in the host computer 350 in the form of software. The printer driver 351 generates print data from image data, such as a document, a photograph, or the like desired by a user and transmits the generated print data to the inkjet recording apparatus 10 according to the present exemplary embodiment in accordance with a print instruction issued by the user.

A reception buffer 301 is a buffer for holding the print data and the like transmitted from the host computer 350 to the inkjet recording apparatus 10 according to the present exemplary embodiment. The print data and the like held by the reception buffer 301 are transferred to a random access memory (RAM) 303 and temporarily stored therein under management of a central processing unit (CPU) 302. A read only memory (ROM) 304 is a storage area storing therein a program, fixed data, and the like required for various types of control of the inkjet recording apparatus 10. A nonvolatile random access memory (NVRAM) 305 is a nonvolatile memory NVRAM for storing information that should be stored even when the inkjet recording apparatus 10 is powered off.

A head driver 306 is a driver for driving the recording head 100. A motor driver 307 is a driver for driving various kinds of motors 317, such as the carriage motor, the conveyance motor, and a motor for vertically moving the cap 130. A sensor controller 308 is a controller for controlling various kinds of sensors 318. A user interface (UI) unit controller 309 is a controller for controlling a UI unit 319 of the inkjet recording apparatus 10. Assume that the UI unit 319 includes a display unit for displaying various kinds of information and an operation unit for receiving an operation from the user. The CPU 302 performs various kinds of processing operations such as a calculation, control, a determination, and a setting in cooperation with the RAM 303, the ROM 304, the NVRAM 305, and each of the other units.

[Processing Sequence]

In the following description, an ink discharge sequence according to the present exemplary embodiment that is performed when, for example, the inkjet recording apparatus 10 is transported or is discarded will be described with reference to FIGS. 4 and 5.

Figure 4:
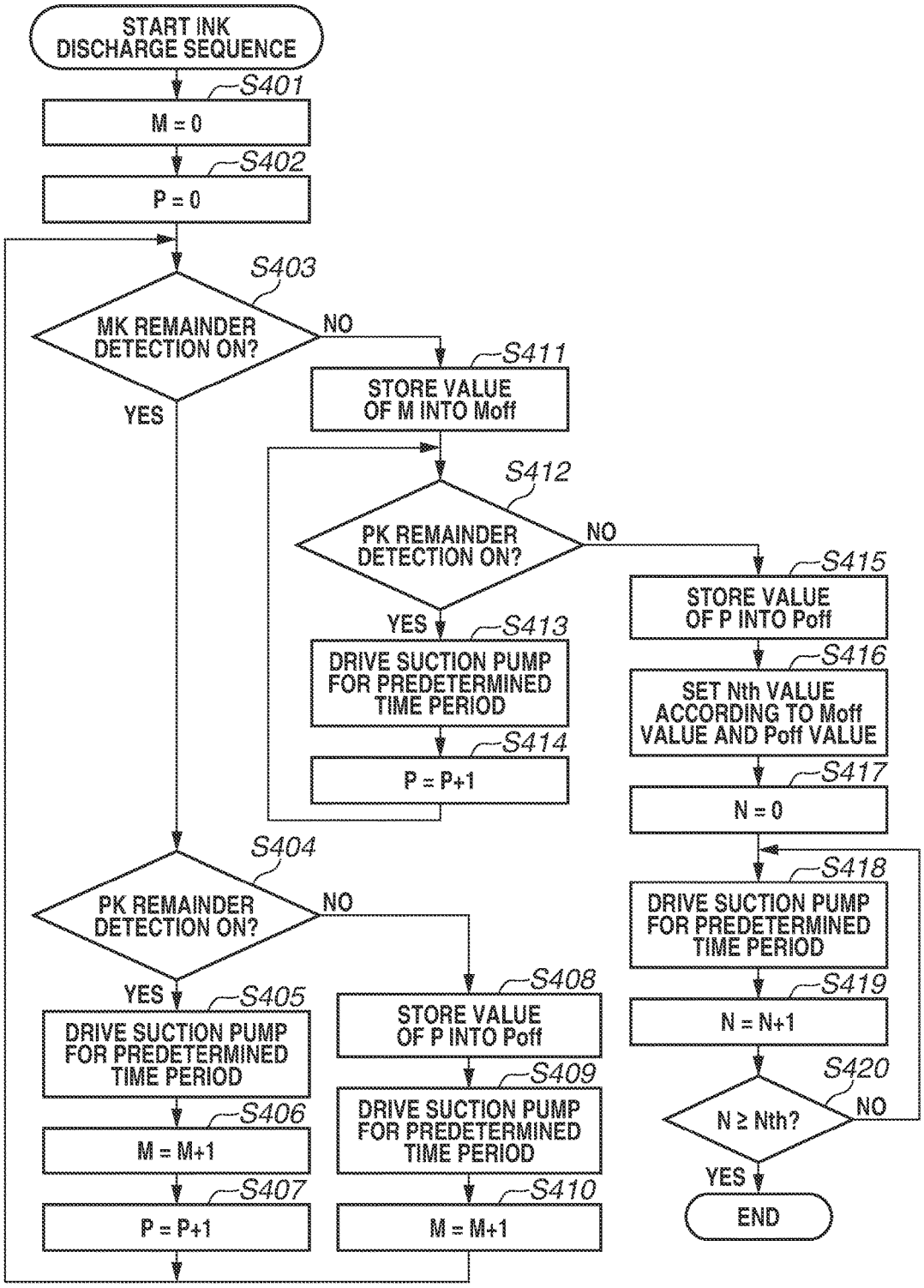
FIG. 4 is a flowchart illustrating an ink discharge sequence according to the first exemplary embodiment.

FIG. 4 is a flowchart illustrating the ink discharge sequence according to the present exemplary embodiment. The ink discharge sequence according to the present exemplary embodiment is started by using the UI unit 319 provided to the inkjet recording apparatus 10 and, for example, pressing a start key displayed on the UI unit 319. However, the start of this sequence is not limited to such an example, and this sequence may be set so as to be started through another method, such as an instruction from the host computer 350.

When the ink discharge sequence is started, in steps S401 and S402, the CPU 302 resets values of two counters M and P to "0". The counter M and the counter P used at this time are a counter corresponding to the matte black ink and a counter corresponding to the photo black ink, respectively.

In step S403, the CPU 302 carries out the ink remainder detection with respect to the ink tank 250 MK for the matte black ink, and determines whether a result thereof is the remainder detection ON. If the result is the remainder detection ON (YES in step S403), the processing proceeds to step S404. If the result is the remainder detection OFF (NO in step S403), the processing proceeds to step S411.

In step S404, the CPU 302 carries out the ink remainder detection with respect to the ink tank 250PK for the photo black ink, and determines whether a result thereof is the remainder detection ON. If the result is the remainder detection ON (YES in step S404), the processing proceeds to step S405. If the result is the remainder detection OFF (NO in step S404), the processing proceeds to step S408.

In step S405, the CPU 302 positions the cap 130 at the capping position relative to the recording head 100 and causes the suction pump 140 to perform a suction operation for a predetermined time period in this state by controlling the various kinds of motors 317 and the head driver 306. A tube pump is used for the suction pump 140 according to the present exemplary embodiment, but another type of suction pump may be used therefor. Assume that a specific value of the predetermined time period according to the present exemplary embodiment is approximately 20 seconds. Assume that, in step S405, both the matte black ink and the photo black ink are sucked and discharged by approximately 4 ml for each of them from the respective ink ejection port arrays 101MK and 101PK with the pump driving (the suction operation) lasting for approximately 20 seconds. Assume that this predetermined time period is provided in advance and stored in the NVRAM 305 or the like. Further, the above-described specific value of the predetermined time period is one example, and the predetermined time period is not limited to this example. The predetermined time period may be defined according to, for example, a size of the ink tank.

After the processing in step S405, in steps S406 and S407, the CPU 302 increments the values of the counters M and P by one. After that, the processing returns to step S403. In other words, the processing in steps S403 to S407 is repeated while a result of the ink remainder detection is the remainder detection ON with respect to both the ink tank 250MK for the matte black ink and the ink tank 250PK for the photo black ink.

In step S408, the CPU 302 stores the value of the counter P into Poff. In other words, how many times the driving of the suction pump 140 lasting for the predetermined time period (approximately 20 seconds) in step S405 has been repeated before the remainder detection result is switched to the remainder detection OFF with respect to the ink tank 250PK for the photo black ink is stored into Poff.

In step S409, the CPU 302 causes the suction pump 140 to perform the suction operation for the predetermined time period (approximately 20 seconds) as in step S405.

In step S410, the CPU 302 increments the value of the counter M by one. After that, the processing returns to step S403. In other words, the processing in steps S408 to S410 is repeated until the remainder detection result is switched to the remainder detection OFF with respect to the ink tank 250MK for the matte black ink. The value of the counter P is stored into Poff in step S408 every time the processing in steps S408 to S410 is repeated, but the value of P stored at this time is the same value every time. In other words, a value indicating how many times the suction operation of the suction pump 140 in step S405 has been performed before the remainder detection result is switched to the remainder detection OFF with respect to the ink tank 250PK for the photo black ink is stored every time.

Needless to say, the photo black ink is also sucked and discharged from the ink ejection port array 101PK during the suction operation of the suction pump 140 in step S409. Further, in a case where the suction operation of the suction pump 140 in step S409 is repeated over and over, the photo black ink in the ink supply system in communication with the ink ejection port array 101PK gradually reduces, and eventually leads to suction and discharge of an atmosphere, i.e., air together therewith as well. If this happens, a flow path resistance reduces in the ink supply system for the photo black ink, so that the sucked and discharged amount of the matte black ink, which is sucked and discharged from the ink ejection port array 101MK at the same time, is reducing. In the present exemplary embodiment, the sucked and discharged amount of the matte black ink at this time reduces from the above-described amount, approximately 4 ml, to as small as approximately 2 ml in the end.

In step S411, the CPU 302 stores the value of the counter M into Moff. In other words, a value indicating how many times the suction operation in steps S405 and S409 has been performed before the remainder detection result is switched to the remainder detection OFF with respect to the ink tank 250MK for the matte black ink is stored into Moff.

In step S412, the CPU 302 determines whether the remainder detection result is ON with respect to the ink tank 250PK. If the result of the ink remainder detection is the remainder detection OFF (NO in step S412), the processing proceeds to step S415. If the result of the ink remainder detection is the remainder detection ON (YES in step S412), the processing proceeds to step S413.

In step S413, the CPU 302 causes the suction pump 140 to perform the suction operation for the predetermined time period (approximately 20 seconds) as in step S405. As in the operation in the case of step S409, the matte black ink is also sucked and discharged from the ink ejection port array 101MK during the suction operation of the suction pump 140 in step S413. In a case where the suction operation of the suction pump 140 in step S413 is repeated over and over, the matte black ink in the ink supply system in communication with the ink ejection port array 101MK gradually reduces, and eventually leads to suction and discharge of an atmosphere, i.e., air together therewith as well. If this happens, the flow path resistance reduces in the ink supply system for the matte black ink, so that the sucked and discharged amount of the photo black ink, which is sucked and discharged from the ink ejection port array 101PK at the same time, is reducing. In the present exemplary embodiment, the sucked and discharged amount of the photo black ink at this time reduces from the above-described amount, approximately 4 ml, to as small as approximately 2 ml in the end.

In step S414, the CPU 302 increments the value of the counter P by one. After that, the processing returns to step S412. In other words, the processing in steps S413 and S414 is repeated until the remainder detection result is switched to the remainder detection OFF with respect to the ink tank 250MK for the photo black ink.

In step S415, the CPU 302 stores the value of the counter P into Poff. In other words, a value indicating how many times the pump driving in steps S405 and S413 has been repeated before the remainder detection result is switched to the remainder detection OFF with respect to the ink tank 250PK for the photo black ink is stored into Poff.

In step S416, the CPU 302 sets a threshold value Nth according to the values of Moff and Poff. In the present exemplary embodiment, the CPU 302 determines and sets a value of the threshold value Nth with use of a table 500 illustrated in FIG. 5. For example, if the value of Moff or Poff is 0, the threshold value Nth is set to "9". Alternatively, if a difference between the value of Moff and the value of Poff is 0, the threshold value Nth is set to "5". Alternatively, if the difference between the value of Moff and the value of Poff is five or more, the threshold value Nth is set to "9". Hereinafter, the difference between the value of Moff and the value of Poff will also be referred to as an OFF difference. The conditions for setting the threshold value Nth indicated in the table 500 are one example, and the inkjet recording apparatus 10 may be configured to use another value or condition. The conditions for the setting will be described below.

In step S417, the CPU 302 resets a value of a counter N to "0".

In step S418, the CPU 302 causes the suction pump 140 to perform the suction operation for the predetermined time period (approximately 20 seconds) as in step S405.

In step S419, the CPU 302 increments the value of the counter N by one.

In step S420, the CPU 302 determines whether the value of the counter N is the value of the threshold value Nth or larger. If the value of the counter N is N>=Nth (YES in step S420), the present processing flow ends. If the value of the counter N is N<Nth (NO in step S420), the processing returns to step S418. This means that the present processing flow ends after the driving of the suction pump 140 lasting for the predetermined time period is repeated Nth times after the remainder detection result is switched to the remainder detection OFF with respect to both the ink tank 250MK for the matte black ink and the ink tank 250PK for the photo black ink. Then, an operation condition (strength such as the number of times) of the suction operation to be performed after both the remainder detection results are switched to the remainder detection OFF is determined based on the suction operation until both the remainder detection results are switched to the remainder detection OFF.

FIG. 5 illustrates an example of a structure of the table 500 used to set the threshold value Nth according to the present exemplary embodiment.

The setting of the threshold value Nth will be described referring to an example in a case where the ink discharge sequence illustrated in FIG. 4 is started in such a state that only a small amount of ink remains in the ink tank 250PK for the photo black ink and a sufficient amount of ink remains in the ink tank 250MK for the matte black ink.

In this case, only the small amount of the photo black ink remains in the ink tank 250PK, so that the remainder detection result is switched to the remainder detection OFF with respect to the ink tank 250PK by the pump driving in step S405 that is repeated several times. The fact that the remainder detection result is switched to the remainder detection OFF with respect to the ink tank 250PK is equivalent to a descent of the ink liquid surface 290PK of the photo black ink in the ink tank 250PK to a lower position than the remainder detection position E illustrated in FIG. 2. In a case where the pump driving in step S409 is repeated from this state, the photo black ink in the ink supply system PK gradually reduces further, and eventually leads to suction and discharge of the atmosphere, i.e., the air from the ink ejection port array 101PK together therewith as well. If this happens, the flow path resistance reduces in the ink supply system PK, and the sucked and discharged amount of the matte black ink, which is sucked and discharged at the same time, is reducing even with the matte black ink sufficiently remaining in the ink supply system MK.

To that end, the ink cannot be sucked and discharged by an substantially entire amount from the inkjet recording apparatus 10 unless the threshold value Nth is set to a larger value when the OFF difference is large than when the OFF difference is small. In the present exemplary embodiment, the table 500 is defined in such a manner that the threshold value Nth increases as the OFF difference increases as illustrated in FIG. 5. When the value of Poff is zero, the photo black ink may be little left in the ink supply system PK already before the start of the ink discharge sequence. In a case where the photo black ink is little left in the ink supply system PK, the ink supply system PK has a low flow path resistance, so that the sucked and discharged amount of the matte black ink, which is sucked and discharged at the same time, reduces. Thus, when the value of Poff is 0, the threshold value Nth is set to the highest value, "9". The same also applies to when the value of Moff is zero, and therefore a description thereof will be omitted. In an opposite case, i.e., in a case where the ink discharge sequence is started from such a state that only a small amount of ink remains in the ink tank 250MK but a sufficient amount of ink remains in the ink tank 250PK, the same also applies thereto and therefore a description thereof will be omitted.

In this manner, according to the present exemplary embodiment, the ink can be sucked and discharged by the substantially entire amount from the ink supply system of the inkjet recording apparatus 10 without spending a long time.

The ink discharge sequence according to the present exemplary embodiment includes several processes for storing the same value of P into Poff, but may be arranged so as to cause the value of the counter P to be stored into Poff only when the remainder detection result is switched to the remainder detection OFF with respect to the ink tank 250PK for the first time.

In the present exemplary embodiment, the amount of the ink remaining in the ink supply system when the result of the ink remainder detection is switched to the remainder detection OFF is approximately 17 ml for both the photo black ink and the matte black ink, but the photo black ink and the matte black ink do not necessarily have to remain by substantially same amounts. In a case where the amounts of the remaining ink are different from each other, the intended result can be obtained by arranging the above-described processing so as to set the threshold value Nth in consideration of the type, the ink tank size, and/or the like of the ink with respect to which the remainder detection result is switched to the remainder detection OFF last.

[Configuration of Apparatus]

Figure 6:
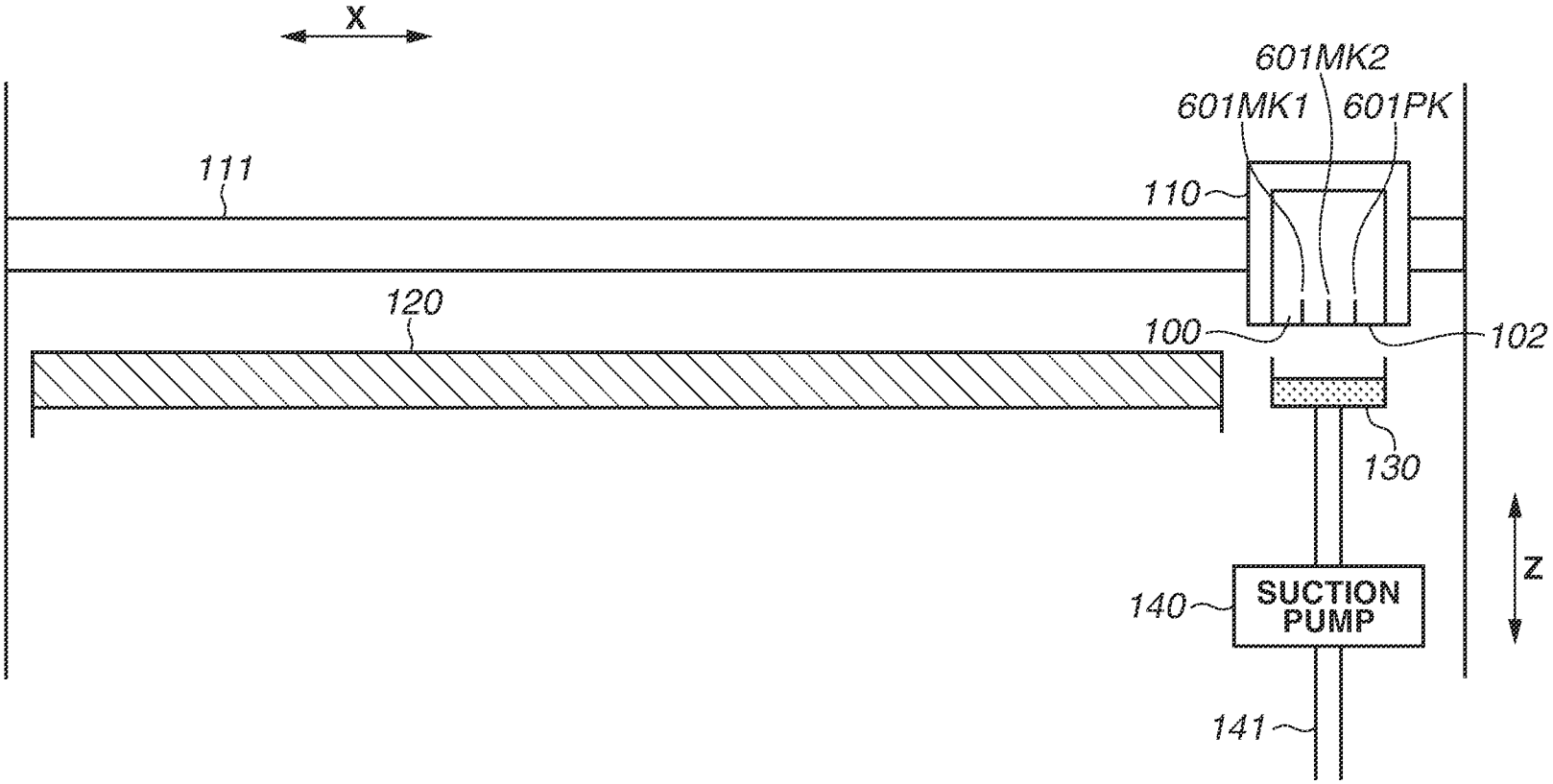
FIG. 6 is a schematic cross-sectional view illustrating one example of an inkjet recording apparatus according to a second exemplary embodiment.

A second exemplary embodiment of the present disclosure will be described below in detail. FIG. 6 illustrates a schematic cross-sectional view (main portions) of an inkjet recording apparatus according to the present exemplary embodiment. In FIG. 6, components labeled the same reference numerals as those in FIG. 1 indicate similar elements thereto, and thus descriptions thereof will be omitted.

The recording head 100 includes ink ejection port arrays 601MK1, 601MK2, and 601PK that eject ink, on the ink ejection port surface 102. The ink ejection port array 601MK1 and the ink ejection port array 601MK2 eject the matte black ink. The ink ejection port array 601PK ejects the photo black ink. In other words, in the present exemplary embodiment, the recording head 100 includes three ink ejection port arrays corresponding to two kinds (two colors) of ink. Assume that configurations other than these are similar to the first exemplary embodiment.

Next, an ink supply system of the inkjet recording apparatus according to the present exemplary embodiment will be described with reference to FIGS. 7 and 8.

Figure 7:
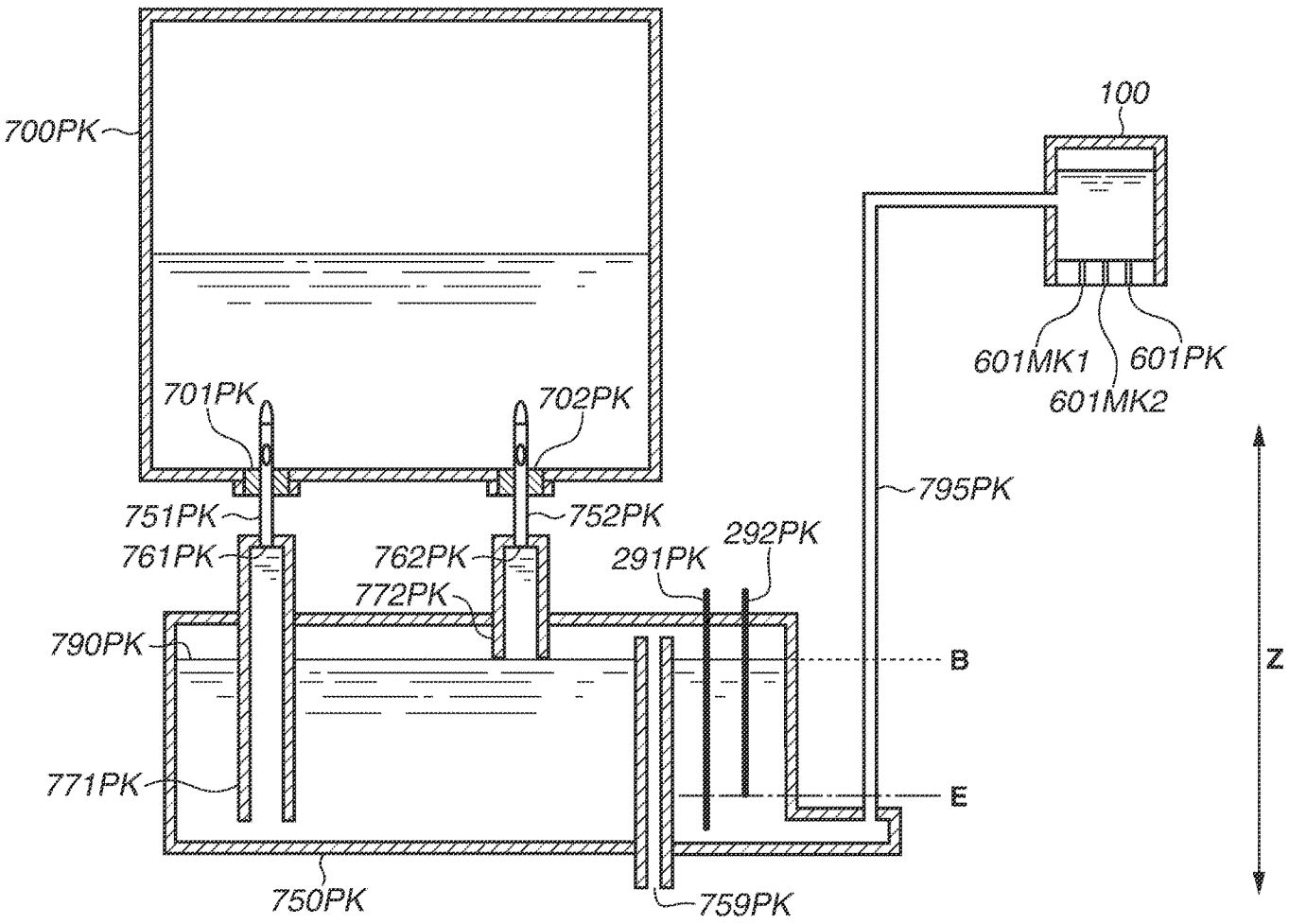
FIG. 7 is a schematic cross-sectional view illustrating one example of an ink supply system according to the second exemplary embodiment.

FIG. 7 is a schematic cross-sectional view (main portions) of an ink supply system in communication with the ink ejection port array 601PK that ejects the photo black ink (PK). In FIG. 7, components labeled the same reference numerals as those in FIG. 2 indicate similar elements thereto, and thus descriptions thereof will be omitted.

The ink ejection port array 601PK of the recording head 100 is in communication with a sub tank 750PK via a supply tube 795PK. The sub tank 750PK stores the photo black ink therein and includes an atmosphere communication port 759PK. The sub tank 750PK is provided with two metallic hollow needles 751PK and 752PK. The sub tank 750PK and a main tank 700PK are in communication with each other via these two hollow needles 751PK and 752PK. The main tank 700PK is configured detachably from and attachably to the sub tank 750PK.

The two hollow needles 751PK and 752PK provided to the sub tank 750PK penetrate through, respectively, rubber plugs 701PK and 702PK provided to the main tank 700PK when the main tank 700PK is attached to the sub tank 750PK. As a result, the sub tank 750PK and the main tank 700PK are brought into communication with each other. Hereinafter, the hollow needle 751PK and the hollow needle 752PK will also be referred to as a first hollow needle and a second hollow needle, respectively.

Further, a first flow path 771PK is connected to a sub tank-side opening 761PK of the first hollow needle 751PK, and the first flow path 771PK extends to around a bottom portion of the sub tank 750PK. A second flow path 772PK is connected to a sub tank-side opening 762PK of the second hollow needle 752PK, and a position of an opening of the second flow path 772PK on one side where the second flow path 772PK is not connected to the second hollow needle 752PK corresponds to a position in the vertical direction that is indicated by B in FIG. 7.

The sub tank 750PK is provided with two electrodes 291PK and 292PK functioning as the detection unit as in the first exemplary embodiment, and the ink remainder detection is carried out by detecting a voltage value when a micro current is applied to between these two electrodes 291PK and 292PK. Assume that, in the present exemplary embodiment, an amount of the photo black ink remaining in the ink supply system PK is approximately 13 ml when an ink liquid surface 790PK in the sub tank 750PK is located at a remainder detection position indicated by E in FIG. 7.

In addition, the inkjet recording apparatus 10 according to the present exemplary embodiment is provided with such a detachment/attachment detection unit (not illustrated) that a detached/attached state of the main tank 700PK from/to the sub tank 750PK can be detected according to whether electric conduction is established. The inkjet recording apparatus 10 according to the present exemplary embodiment is provided with a main tank empty detection unit (not illustrated) that detects whether the main tank 700PK is empty. An optical sensor, a detector that detects the empty state according to whether electric conduction is established between the above-described two metallic hollow needles 751PK and 752PK, or the like can be used as the main tank empty detection unit.

In the following description, a flow of the ink when the photo black ink is ejected from the ink ejection port array 601PK (i.e., the photo black ink is being consumed) will be briefly described.

When the photo black ink is ejected from the ink ejection port array 601PK, a pressure in the recording head 100 reduces, and the photo black ink in the sub tank 750PK moves into the recording head 100 to resolve this pressure reduction. Then, a pressure in the sub tank 750PK reduces but this pressure reduction is resolved by an inflow of air from the atmosphere communication port 759PK. Thus, the ink liquid surface 790PK in the sub tank 750PK is lowered.

When the ink liquid surface 790PK in the sub tank 750PK is lowered and reaches a lower position than the position in the vertical direction that is indicated by B in FIG. 7, the air in the sub tank 750PK moves into the main tank 700PK via the second flow path 772PK and the second hollow needle 752PK. Along therewith, the photo black ink in the main tank 700PK moves into the sub tank 750PK via the first hollow needle 751PK and the first flow path 771PK. In other words, bird feeding is carried out. Therefore, an ink liquid surface in the main tank 700PK is being lowered with the consumption of the photo black ink, but the ink liquid surface 790PK in the sub tank 750PK is substantially kept at the position in the vertical direction that is indicated by B in FIG. 7. Hereinafter, the position in the vertical direction that is indicated by B in FIG. 7 will also be referred to as a bird feeding liquid surface position.

While the photo black ink is left in the main tank 700PK, the ink liquid surface 790PK in the sub tank 750PK is substantially kept at the bird feeding liquid surface position. However, if the photo black ink is being further consumed, eventually, the main tank 700PK is emptied. When the main tank 700PK is emptied and the main tank empty detection unit (not illustrated) detects the empty state of the main tank 700PK, the inkjet recording apparatus 10 issues a notification indicating that the main tank 700PK is emptied to the user. With this notification, the inkjet recording apparatus 10 prompts the user to exchange the main tank 700PK. In this state, the ink ejection from the ink ejection port array 601PK is not interrupted. In other words, in the present exemplary embodiment, the inkjet recording apparatus 10 is configured and controlled so as to be able to continue the ink ejection by using the photo black ink in the sub tank 750PK even after the main tank 700PK is emptied.

If the ink ejection from the ink ejection port array 601PK continues with the main tank 700PK emptied, the ink liquid surface 790PK in the sub tank 750PK is being lowered, and eventually reaches a lower position than the remainder detection position. When the ink liquid surface 790PK in the sub tank 750PK reaches the lower position than the remainder detection position and the remainder detection OFF is detected by the ink remainder detection, the inkjet recording apparatus 10 interrupts the ink ejection.

In the above description, the flow of the ink when the ink is consumed by the ink ejection has been described, but the ink also flows in a similar manner when the photo black ink is sucked and discharged from the ink ejection port array 601PK with use of the suction pump 140, and thus, a description thereof will be omitted.

Further, a position of the sub tank 750PK in the vertical direction and another layout thereof are set in such a manner that the ink liquid surface 790PK in the ink tank 250PK is located at a lower position in the direction of gravitational force than the ink ejection port surface 102 of the recording head 100. Thus, the pressure in the recording head 100 is kept at the negative pressure due to the hydraulic head difference. Further, the position of the sub tank 750PK in the vertical direction and the other layout thereof are set so as to prevent the meniscus formed at the ink ejection ports from being destroyed due to this negative pressure.

Subsequently, an ink supply system in communication with the ink ejection port arrays 601MK1 and 601MK2 that eject the matte black ink will be described.

Figure 8:
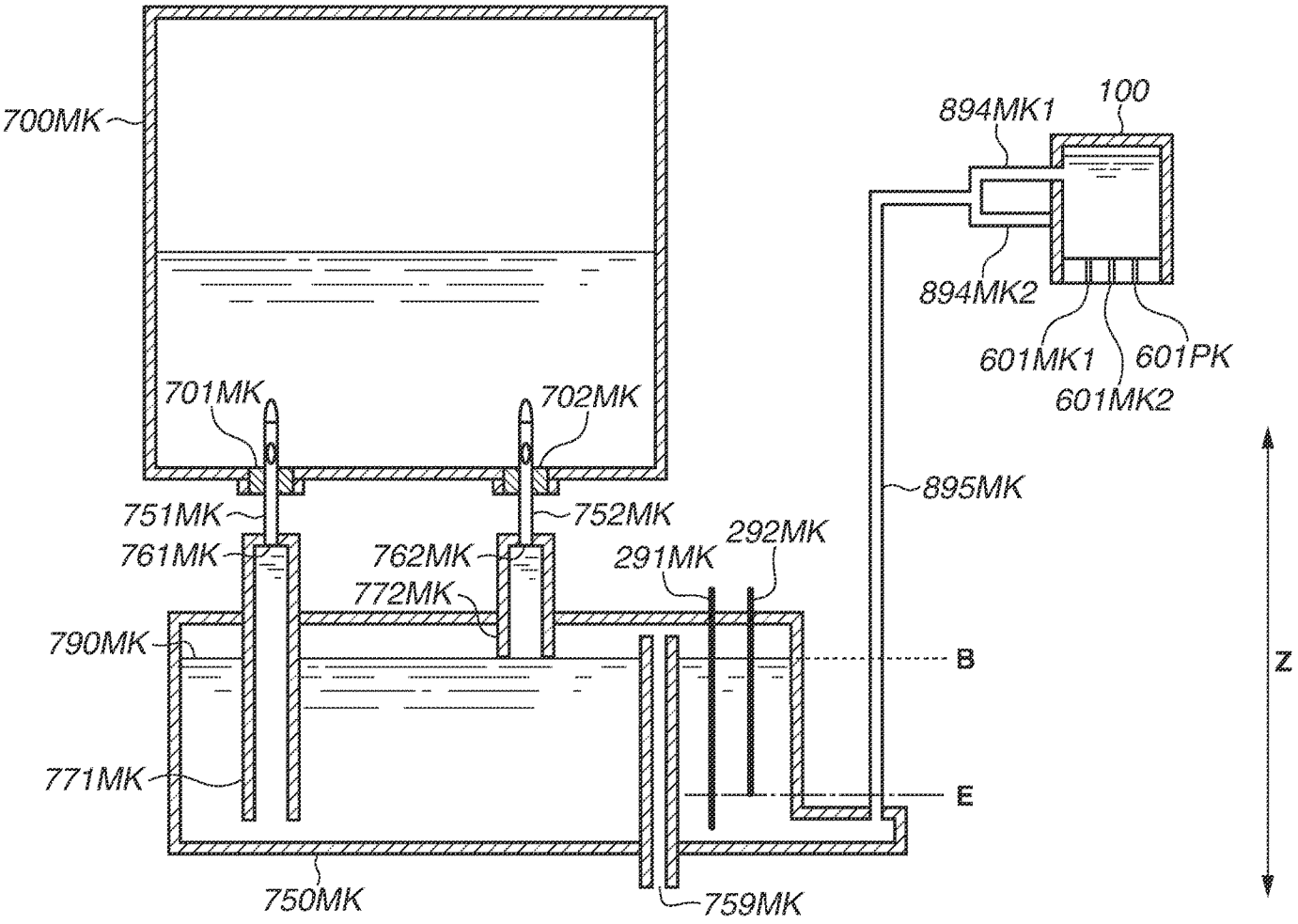
FIG. 8 is a schematic cross-sectional view illustrating one example of an ink supply system according to the second exemplary embodiment.

FIG. 8 is a schematic cross-sectional view (main portions) of the ink supply system in communication with the ink ejection port arrays 601MK1 and 601MK2 that eject the matte black ink (MK). In FIG. 8, components labeled the same reference numerals as those in FIG. 2 or 7 indicate similar elements thereto, and thus descriptions thereof will be omitted. Further, hereinafter, the ink supply system in communication with the ink ejection port arrays 601MK1 and 601MK2 that eject the matte black ink will also be referred to as the ink supply system MK.

The ink ejection port array 601MK1 of the recording head 100 is in communication with a sub tank 750MK via supply tubes 894MK1 and 895MK. Similarly, the ink ejection port array 601MK2 is in communication with the sub tank 750MK via a supply tube 894MK2 and the supply tube 895MK. The sub tank 750MK stores the matte black ink therein and includes an atmosphere communication port 759MK. In other words, the single sub tank 750MK, and the two ink ejection port arrays 601MK1 and 601MK2 are in communication with each other. FIG. 8 illustrates the ink supply system MK as if a position of the supply tube 894MK1 in the vertical direction is located at a higher position than a position of the supply tube 894MK2 in the vertical direction. However, actually, a position where the supply tube 894MK1 and the recording head 100 are connected to each other is substantially the same position in the vertical direction as a position where the supply tube 894MK2 and the recording head 100 are connected to each other. This connection position is also substantially the same position in the vertical direction as a position where the supply tube 795PK and the recording head 100 are connected to each other (refer to FIG. 7).

Assume that, in the present exemplary embodiment, an amount of the matte black ink remaining in the ink supply system MK is approximately 13 ml when an ink liquid surface 790MK in the sub tank 750MK for the matte black ink is located at a remainder detection position indicated by E in FIG. 8.

[Processing Sequence]

In the following description, an ink discharge sequence according to the present exemplary embodiment, which is performed when, for example, the apparatus is transported or discarded will be described with reference to FIG. 9. A block diagram illustrating a control system of the inkjet recording apparatus 10 according to the present exemplary embodiment is similar to the block diagram illustrated in FIG. 3, and thus, a description thereof will be omitted.

The ink discharge sequence according to the present exemplary embodiment is also started by using the UI unit 319 provided to the inkjet recording apparatus 10 and, for example, pressing the start key. During the ink discharge sequence that will be described below, guidance or the like can be presented as appropriate with use of the UI unit 319.

When the ink discharge sequence is started, in step S901, the CPU 302 issues a notification indicating detachments of the main tanks 700PK and 700MK from the inkjet recording apparatus 10 to the user. When the detachment/attachment detection unit (not illustrated) detects that the user detaches the main tanks 700PK and 700MK in response to this notification, the processing proceeds to step S902.

In step S902, the CPU 302 carries out the ink remainder detection with respect to the sub tank 750MK for the matte black ink, and then determines whether the result of the ink remainder detection is the MK remainder detection ON. If a result of the ink remainder detection is the remainder detection ON (YES in step S902), the processing proceeds to step S903. If the result of the ink remainder detection is the remainder detection OFF (NO in step S902), the processing proceeds to step S908.

In step S903, the CPU 302 carries out the ink remainder detection with respect to the sub tank 750PK for the photo black ink, and then determines whether a result of the ink remainder detection is the PK remainder detection ON. If the result of the ink remainder detection is the remainder detection ON (YES in step S903), the processing proceeds to step S904. If the result of the ink remainder detection is the remainder detection OFF (NO in step S903), the processing proceeds to step S905.

In step S904, the CPU 302 positions the cap 130 at the capping position relative to the recording head 100 and causes the suction pump 140 to perform the suction operation for a predetermined time period in this state by controlling the various kinds of motors 317 and the head driver 306. The tube pump is also used for the suction pump 140 according to the present exemplary embodiment, but another type of suction pump can be used therefor. Further, assume that a specific value of the above-described predetermined time period according to the present exemplary embodiment is approximately 30 seconds. Assume that the photo black ink is sucked and discharged by approximately 6 ml from the ink ejection port array 601PK by the pump driving lasting for approximately 30 seconds in step S904. On the other hand, assume that the matte black ink is sucked and discharged by approximately 6 ml for each of them, i.e., by approximately 12 ml in total from the ink ejection port arrays 601MK1 and 601MK2.

After the processing in step S904, the processing returns to step S902. In other words, steps S902 to S904 are repeated as long as a result of the ink remainder detection is the remainder detection ON with respect to both the sub tank 750MK for the matte black ink and the sub tank 750PK for the photo black ink. As steps S902 to S904 are repeated, eventually, a result of the ink remainder detection is switched to the remainder detection OFF since the ink is sucked and discharged in step S904.

In step S905, the CPU 302 causes the suction pump 140 to perform the suction operation for the predetermined time period (approximately 30 seconds) as in step S904. The photo black ink is also sucked and discharged from the ink ejection port array 601PK during the suction operation of the suction pump 140 in step S905. Further, in a case where the driving of the suction pump 140 lasting for the predetermined time period in step S905 is repeated over and over, the photo black ink in the ink supply system in communication with the ink ejection port array 601PK gradually reduces, and eventually leads to suction and discharge of an atmosphere, i.e., air together therewith as well. If this happens, the flow path resistance reduces in the ink supply system for the photo black ink, so that the sucked and discharged amount of the matte black ink, which is sucked and discharged from the ink ejection port arrays 601MK1 and 601MK2 at the same time, is reducing. In the present exemplary embodiment, the sucked and discharged amount of the matte black ink at this time reduces from the above-described amount, approximately 12 ml, to as small as approximately 8 ml in the end.

A degree of the reduction in the sucked and discharged amount of the matte black ink at this time is smaller than a degree of the reduction in the sucked and discharged amount of the matte black ink in step S409 described in the first exemplary embodiment. The reason therefor is as follows. In the first exemplary embodiment, the ink ejection port arrays subjected to the suction at the same time are one ink ejection port array in communication with the ink supply system PK in which the flow path resistance reduces and one ink ejection port array in communication with the ink supply system MK in which the flow path resistance does not reduce. By contrast, in the present processing process, the ink ejection port arrays subjected to the suction at the same time are one ink ejection port array in communication with the ink supply system PK in which the flow path resistance reduces and two ink ejection port arrays in communication with the ink supply system MK in which the flow path resistance does not reduce.

In step S906, the CPU 302 carries out the ink remainder detection with respect to the sub tank 750MK for the matte black ink, and then determines whether the remainder detection result thereof is the remainder detection ON. If the remainder detection result is the remainder detection ON (YES in step S906), the processing proceeds to step S905. If the remainder detection result is the remainder detection OFF (NO in step S906), the processing proceeds to step S907. In other words, steps S905 and S906 are repeated until the remainder detection result is switched to the remainder detection OFF with respect to the sub tank 750MK for the matte black ink.

In step S907, the CPU 302 sets a threshold value Lth to a value LM. Assume that a specific value of LM according to the present exemplary embodiment is "2". After that, the processing proceeds to step S911.

In step S911, the CPU 302 resets a value of a counter L to "0".

In step S912, the CPU 302 causes the suction pump 140 to perform the suction operation for the predetermined time period (approximately 30 seconds) similarly to step S904.

In step S913, the CPU 302 increments the value of the counter L by one.

In step S914, the CPU 302 determines whether the value of the counter L is the threshold value Lth or larger. If the value of the counter L is the threshold value Lth or larger (YES in step S914), the present processing flow ends. If the value of the counter L is smaller than the threshold value Lth (NO in step S914), the processing returns to step S912. In other words, the present ink discharge sequence ends after the suction operation by the suction pump 140 lasting for the predetermined time period is performed Lth times since switch of the remainder detection result to the remainder detection OFF with respect to the sub tank 750MK for the matte black ink.

In step S908, the CPU 302 carries out the ink remainder detection with respect to the sub tank 750PK for the photo black ink, and then determines whether the remainder detection result thereof is the remainder detection ON. If the remainder detection result thereof is the remainder detection ON (YES in step S908), the processing proceeds to step S909. If the remainder detection result thereof is the remainder detection OFF (NO in step S908), the processing proceeds to step S910.

In step S909, the CPU 302 causes the suction pump 140 to perform the suction operation for the predetermined time period (approximately 30 seconds) as in step S904. After that, the processing returns to step S908. In other words, steps S908 and S909 are repeated until the remainder detection result is switched to the remainder detection OFF with respect to the sub tank 750PK for the photo black ink. The matte black ink is also sucked and discharged from the ink ejection port arrays 601MK 1 and 601MK2 during the driving of the suction pump 140 lasting for the predetermined time period in step S909. Further, in a case where the driving of the suction pump 140 lasting for the predetermined time period in step S909 is repeated over and over, the matte black ink in the ink supply system MK gradually reduces, and eventually leads to suction and discharge of an atmosphere, i.e., air together therewith as well. If this happens, the flow path resistance reduces in the ink supply system MK, so that the sucked and discharged amount of the photo black ink, which is sucked and discharged at the same time, is reducing. In the present exemplary embodiment, the sucked and discharged amount of the photo black ink at this time reduces from the above-described amount, approximately 6 ml, to as small as approximately 2 ml in the end.

A degree of the reduction in the sucked and discharged amount of the photo black ink at this time is larger than the degree of the reduction in the sucked and discharged amount of the matte black ink in step S905. The reason therefor is as follows. In step S905, the ink ejection port arrays subjected to the suction at the same time are one ink ejection port array in communication with the ink supply system PK in which the flow path resistance reduces and two ink ejection port arrays in communication with the ink supply system MK in which the flow path resistance does not reduce. By contrast, in the present processing process, the ink ejection port arrays subjected to the suction at the same time are two ink ejection port arrays in communication with the ink supply system MK in which the flow path resistance reduces and one ink ejection port array in communication with the ink supply system PK in which the flow path resistance does not reduce.

In step S910, the CPU 302 sets the threshold value Lth to a value LP. Assume that a specific value of LP according to the present exemplary embodiment is "7". After that, the processing proceeds to step S911. As described above, the present ink discharge sequence ends after the suction operation by the suction pump 140 lasting for the predetermined time period is performed Lth times since the remainder detection result is switched to the remainder detection OFF with respect to the sub tank 750PK for the photo black ink.

Now, the value set as the threshold value Lth used in the above-described processing will be described. In a case where the remainder detection result is switched to the remainder detection OFF with respect to the sub tank 750PK before the remainder detection result is switched to the remainder detection OFF with respect to the sub tank 750MK, the value LM is set as the threshold value Lth. In this case, the air may be sucked and discharged together with the photo black ink from the ink ejection port array 601PK during the suction operation by the suction pump 140 lasting for the predetermined time period in steps S905 and S912. In other words, at the time of the pump driving in step S912, the ink supply system PK has a reduced flow path resistance, which causes a reduction in the sucked and discharged amount of the matte black ink sucked and discharged at the same time and may lead to a reduction thereof to as small as approximately 8 ml as described above if this amount reduces to the smallest amount. In such a case, LM is also set as a value that allows the matte black ink to be sucked and discharged by the substantially entire amount from the ink supply system MK.

By contrast, in a case where the remainder detection result is switched to the remainder detection OFF with respect to the sub tank 750MK before or substantially at the same time that the remainder detection result is switched to the remainder detection OFF with respect to the sub tank 750PK, the value LP is set as the threshold value Lth. In this case, the air may be sucked and discharged together with the matte black ink from the ink ejection port arrays 601MK1 and 601MK2 during the suction operation performed by the suction pump 140 lasting for the predetermined time period in steps S909 and S912. In other words, at the time of the pump driving in step S912, the ink supply system MK has a reduced flow path resistance, which causes a reduction in the sucked and discharged amount of the photo black ink sucked and discharged at the same time and may lead to a reduction thereof to as small as approximately 2 ml as described above if this amount reduces to the smallest amount. In such a case, LP is also set as a value that allows the photo black ink to be sucked and discharged by the substantially entire amount from the ink supply system PK.

At this time, assume that LP is twice as large as LM. The reason therefor will be described below. When the suction pump 140 is driven for the predetermined time period (approximately 30 seconds), the ink is sucked and discharged by approximately 6 ml from each of the ink ejection port arrays 601PK, 601MK1, and 601MK2 if the flow path resistances do not reduce in the ink supply systems PK and MK. In other words, the photo black ink is sucked and discharged by approximately 6 ml and the matte black ink is sucked and discharged by approximately 12 ml. Thus, LP twice as large as LM is appropriate unless the flow path resistance reduces in each of the ink supply systems. This is because the ink is sucked and discharged for the matte black ink by an amount twice as large as the photo black ink when the driving of the suction pump 140 lasting for the predetermined time period is carried out once.

However, when the ink amount in the ink supply system reduces and the air starts to be also sucked and discharged together with the ink from the ink ejection ports by the driving of the suction pump 140, the flow path resistance reduces in the ink supply system. For example, when the flow path resistance reduces in the ink supply system MK, this causes the reduction in the amount of the photo black ink sucked and discharged by the pump driving from the ink ejection port array 601PK in communication with the ink supply system PK in which the flow path resistance does not reduce. A degree of this reduction increases as the number of ink ejection port arrays increases which is in communication with the ink supply system in which the flow path resistance reduces. Thus, when the flow path resistance reduces in the ink supply system MK in communication with two ink ejection port arrays, the amount of the photo black ink sucked and discharged by the pump driving reduces more largely than the sucked and discharged amount of the matte black ink reduces when the flow path resistance reduces in the ink supply system PK. Thus, the photo black ink cannot be sucked and discharged by the substantially entire amount from the ink supply system PK unless LP is set so as to be twice as large as LM. For such a reason, LP and LM are set in the above-described manner. In a case where the number of ink ejection port arrays and the configuration of the connection to the ink tank are changed, the threshold value Lth is also set based on the above-described idea in a similar manner.

In this manner, in the ink supply system described in the present exemplary embodiment, the ink can also be sucked and discharged by the substantially entire amount without spending a long time.

[Configuration of Apparatus]

Figure 10:
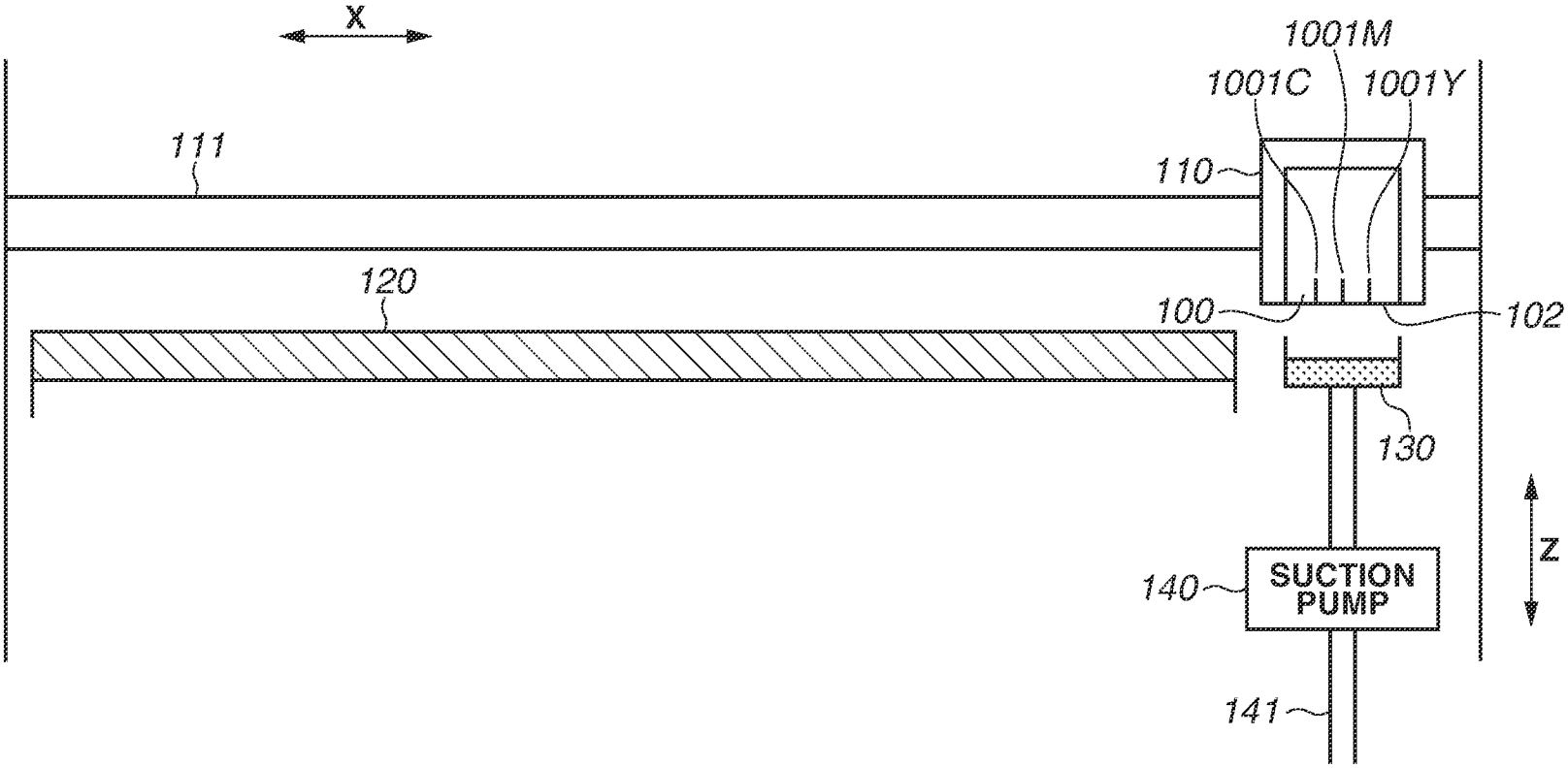
FIG. 10 is a schematic cross-sectional view illustrating one example of an inkjet recording apparatus according to a third exemplary embodiment.

A third exemplary embodiment of the present disclosure will be described below. FIG. 10 illustrates a schematic cross-sectional view (main portions) of an inkjet recording apparatus according to the present exemplary embodiment. In FIG. 10, components labeled the same reference numerals as in FIG. 1 or 6 indicate similar elements thereto, and therefore descriptions thereof will be omitted.

The recording head 100 includes ink ejection port arrays 1001C, 1001M, and 1001Y that eject ink, on the ink ejection port surface 102. The ink ejection port array 1001C ejects cyan ink. The ink ejection port array 1001M ejects magenta ink. The ink ejection port array 1001Y ejects yellow ink. In other words, the recording head 100 according to the present exemplary embodiment includes three ink ejection port arrays corresponding to three kinds (three colors) of ink. Assume that configurations other than these are similar to the first exemplary embodiment.

An ink supply system of the inkjet recording apparatus according to the present exemplary embodiment is assumed to be ink supply systems similar to the ink supply system illustrated in FIG. 7 that are respectively in communication with the ink ejection port arrays that eject the respective colors of ink of the cyan, the magenta, and the yellow, and a description thereof will be omitted. Hereinafter, sub tanks in communication with the ink ejection port arrays 1001C, 1001M, and 1001Y will also be referred to as sub tanks 750C, 750M, and 750Y, respectively. The ink supply systems in communication with the ink ejection port arrays 1001C, 1001M, and 1001Y will also be referred to as ink supply systems C, M, and Y, respectively. Further, assume that, in the present exemplary embodiment, an amount of the ink remaining in the ink supply system of each of the colors is approximately 13 ml for all of the colors when an ink liquid surface in the sub tank of each of the colors is located at the remainder detection position indicated by E in FIG. 7.

[Processing Sequence]

An ink discharge sequence according to the present exemplary embodiment will be described with reference to FIG. 11. A block diagram of a control system of the inkjet recording apparatus according to the present exemplary embodiment is also similar to the block diagram illustrated in FIG. 3, and thus, a description thereof will be omitted.

When the ink discharge sequence is started, in step S1101, the CPU 302 issues a notification indicating detachments of main tanks 700C, 700M, and 700Y from the inkjet recording apparatus to the user. When the detachment/attachment detection unit (not illustrated) detects that the user detaches the main tanks 700C, 700M, and 700Y in response to this notification, the processing proceeds to step S1102.

In step S1102, the CPU 302 resets a value of a counter J to "0".

In step S1103, the CPU 302 carries out the ink remainder detection with respect to the sub tanks 750C, 750M, and 750Y for the respective colors of ink, and then determines whether all of the remainder detection results are the remainder detection ON. If all of the remainder detection results are the remainder detection ON (YES in step S1103), the processing proceeds to step S1104. If there is even only one result indicating the remainder detection OFF (NO in step S1103), the processing proceeds to step S1107. Hereinafter, the ink remainder detection with respect to the sub tank 750C for the cyan ink will also be referred to as the ink remainder detection with respect to the cyan, and the remainder detection result thereof will also be referred to as the remainder detection result with respect to the cyan. The same shall also apply to the other colors. Furthermore, expressions that will be used hereinafter also include an expression, such as the ink remainder detection with respect to each of the colors, an expression, such as the remainder detection result with respect to any of the colors, and an expression, such as the remainder detection ON with respect to any of the colors. Further, when the result of the ink remainder detection is the remainder detection ON with respect to all of the cyan, the magenta, and the yellow, and when the result of the ink remainder detection is the remainder detection OFF with respect to all of the cyan, the magenta, and the yellow, these states will also be referred to as the remainder detection ON with respect to all of the colors and the remainder detection OFF with respect to all of the colors, respectively. Similarly, when two results among the results of the ink remainder detection with respect to the individual colors are the remainder detection ON, this state will also be referred to as the remainder detection ON with respect to two colors and also be referred to as the remainder detection OFF with respect to one color. Assume that the same also applies to the other cases.

In step S1104, the CPU 302 positions the cap 130 at the capping position relative to the recording head 100 and causes the suction pump 140 to perform the suction operation for a predetermined time period in this state by controlling the various kinds of motors 317 and the head driver 306. The tube pump is also used for the suction pump 140 according to the present exemplary embodiment, but another type of suction pump can be used therefor. Further, assume that a specific value of the predetermined time period according to the present exemplary embodiment is approximately 30 seconds. Assume that the ink of each of the colors is sucked and discharged by approximately 6 ml for each of them by the pump driving lasting for approximately 30 seconds in step S1104. After that, the processing proceeds to step S1105.

In step S1105, the CPU 302 increments the value of the counter J by one.

In step S1106, the CPU 302 carries out the ink remainder detection with respect to each of the colors again, and then determines whether the result thereof is the remainder detection ON with respect to all of the colors. If all of the remainder detection results are the remainder detection ON (YES in step S1106), the processing returns to step S1104. If there is even only one result indicating the remainder detection OFF (NO in step S1106), the processing proceeds to step S1107. In other words, steps S1104 to S1106 are repeated as long as the result of the ink remainder detection with respect to each of the colors is the remainder detection ON with respect to all the colors. As steps S1104 to S1106 are repeated, the remainder detection result is eventually switched to the remainder detection OFF with respect to any of the colors since the ink is sucked and discharged in step S1104.

In step S1107, the CPU 302 stores the value of the counter J into Xoff. In other words, a value indicating how many times the suction operation by the suction pump 140 lasting for the predetermined time period (approximately 30 seconds) in step S1104 has been performed before the remainder detection result is switched to the remainder detection OFF with respect to the color switched to the remainder detection OFF first among the other colors of ink is stored into Xoff. Hereinafter, the color, among the other colors, of ink with respect to which the remainder detection result is switched to the remainder detection OFF first will also be referred to as a first remainder detection OFF color. Similarly, the second color with respect to which the remainder detection result is switched to the remainder detection OFF will also be referred to as a second remainder detection OFF color, and the third color with respect to which the remainder detection result is switched to the remainder detection OFF will also be referred to as a third remainder detection OFF color (or a last remainder detection OFF color).

In step S1108, the CPU 302 carries out the ink remainder detection with respect to each of the colors, and then determines whether the result thereof is the two color remainder detection ON. If the remainder detection result is the two color remainder detection ON (YES in step S1108), the processing proceeds to step S1109. If the remainder detection result is a result other than that (NO in step S1108), the processing proceeds to step S1112.

In step S1109, the CPU 302 causes the suction pump 140 to perform the suction operation for the predetermined time period (approximately 30 seconds) as in step S1104. The ink of the first remainder detection OFF color is also sucked and discharged from the corresponding ink ejection port array during the driving of the suction pump 140 lasting for the predetermined time period in step S1109. Then, in a case where the suction operation of the suction pump 140 lasting for the predetermined time period in step S1109 is repeated over and over, the ink of the first remainder detection OFF color in the ink supply system gradually reduces, and eventually leads to suction and discharge of an atmosphere, i.e., air together therewith as well. In this case, the flow path resistance reduces in the ink supply system for the ink of the first remainder detection OFF color, so that the sucked and discharged amounts of the other two colors of ink, which are sucked and discharged at the same time, are reducing. Assume that, in the present exemplary embodiment, the sucked and discharged amounts of the other two colors of ink at this time (when the flow path resistance reduces only in the ink supply system for the ink of the first remainder detection OFF color) reduce from the above-described amount, approximately 6 ml, to as small as approximately 4 ml in the end.

In step S1110, the CPU 302 increments the value of the counter J by one.

In step S1111, the CPU 302 carries out the ink remainder detection with respect to each of the colors again, and then determines whether the result thereof is the two color remainder detection ON. If the remainder detection result is the two color remainder detection ON (YES in step S1111), the processing returns to step S1109. If the remainder detection result is a result other than that (NO in step S1111), the processing proceeds to step S1112. In other words, steps S1109 to S1111 are repeated as long as the result of the ink remainder detection with respect to each of the colors is the two color remainder detection ON.

In step S1112, the CPU 302 stores the value of the counter J into Yoff. In other words, a value indicating how many times the driving of the suction pump 140 lasting for the predetermined time period in steps S1104 and S1109 has been repeated before the remainder detection result is switched to the remainder detection OFF with respect to the second remainder detection OFF color is stored into Yoff.

In step S1113, the CPU 302 carries out the ink remainder detection with respect to each of the colors, and then determines whether the result thereof is the one color remainder detection ON. If the remainder detection result is the one color remainder detection ON (YES in step S1113), the processing returns to step S1114. If the remainder detection result is a result other than that (NO in step S1113), the processing proceeds to step S1117.

In step S1114, the CPU 302 causes the suction pump 140 to perform the suction operation for the predetermined time period (approximately 30 seconds) as in step S1104. The ink of the first remainder detection OFF color and the ink of the second remainder detection OFF color are also sucked and discharged from the corresponding ink ejection port arrays during the driving of the suction pump 140 lasting for the predetermined time period in step S1114. In a case where the suction operation of the suction pump 140 lasting for the predetermined time period in step S1114 is repeated over and over, the ink of the first remainder detection OFF color and the ink of the second remainder detection OFF color in the ink supply systems gradually reduces, and eventually leads to suction and discharge of the atmosphere, i.e., the air together therewith as well. In this case, the flow path resistances also reduce in the ink supply system for the ink of the first remainder detection OFF color and the ink supply system for the ink of the second remainder detection OFF color, so that the sucked and discharged amount of the ink of the other one color, which is sucked and discharged at the same time, is reducing. Assume that, in the present exemplary embodiment, the sucked and discharged amount of the ink of the other one color at this time (when the flow path resistances reduce in the ink supply system for the ink of the first remainder detection OFF color and the ink supply system for the ink of the second remainder detection OFF color) reduces from the above-described amount, approximately 6 ml, to as small as approximately 2 ml in the end.

In step S1115, the CPU 302 increments the value of the counter J by one.

In step S1116, the CPU 302 carries out the ink remainder detection with respect to each of the colors again, and then determines whether the result thereof is the one color remainder detection ON. If the remainder detection result is the one color remainder detection ON (YES in step S1116), the processing returns to step S1114. If the remainder detection result is a result other than that (NO in step S1106), the processing proceeds to step S1117. In other words, steps S1114 to S1116 are repeated as long as the result of the ink remainder detection with respect to each of the colors is the one color remainder detection ON.

In step S1117, the CPU 302 stores the value of the counter J into Zoff. In other words, a value indicating how many times the suction operation by the suction pump 140 lasting for the predetermined time period in steps S1104, S1109, and S1114 has been performed before the remainder detection result is switched to the remainder detection OFF with respect to the last remainder detection OFF color is stored into Zoff.

In step S1118, the CPU 302 sets a threshold value Qth by referring to, for example, a table 1200 illustrated in FIG. 12, according to the values stored in Xoff, Yoff, and Zoff. For example, if a difference between the value of Xoff and the value of Yoff is 1 and a difference between the value of Yoff and the value of Zoff is three or more, the threshold value Qth is set to "7". The table 1200 illustrated in FIG. 12 is created based on a similar idea to the table 500 illustrated in FIG. 5 described in the first exemplary embodiment.

In step S1119, the CPU 302 resets a value of a counter Q to "0".

In step S1120, the CPU 302 causes the suction pump 140 to perform the suction operation for the predetermined time period (approximately 30 seconds) as in step S1104.

In step S1121, the CPU 302 increments the value of the counter Q by one.

In step S1122, the CPU 302 determines whether the value of the counter Q is the threshold value Qth or larger. If the value of the counter Q is the threshold value Qth or larger (YES in step S1122), the present processing flow ends. If the value of the counter Q is smaller than the threshold value Qth (NO in step S1122), the processing returns to step S1120. In other words, the present processing flow ends after the suction operation by the suction pump 140 lasting for the predetermined time period is performed 0th times since the remainder detection result is switched to the remainder detection OFF with respect to the last remainder detection OFF color.

In this manner, according to the present exemplary embodiment, even a configuration illustrated in FIG. 10 enables the ink to be sucked and discharged by the substantially entire amount without spending a long time.

In the present exemplary embodiment, the inkjet recording apparatus sets the threshold value Qth according to the values of Xoff, Yoff, and Zoff. However, the setting of the threshold value Qth is not limited thereto, and the inkjet recording apparatus may be configured to set the threshold value Qth according to, for example, only the values of Yoff and Zoff. This setting enables, for example, the processing in steps S1103 to S1106 illustrated in FIG. 11 to be omitted. Further, this setting also enables a portion other than a portion corresponding to "Xoff=0" to be omitted in the table 1200 illustrated in FIG. 12, thereby enabling the processing to be simplified.

In the present exemplary embodiment, the three colors of ink are used, but aspects of the present disclosure are also effective even when four or more colors of ink are used. Increase in the number of kinds of ink leads to further complication of the processing for setting the threshold value Qth according to all of the timings at which the remainder detection result is switched to the remainder detection OFF with respect to all of the kinds of ink. However, the advantageous effects of aspects of the present disclosure can be relatively easily acquired by arranging the processing so as to set the value of the threshold value Qth according to only the timings at which the remainder detection result is switched to the remainder detection OFF with respect to the last remainder detection OFF color and the color immediately before the last remainder detection OFF color as described above.

Figure 13:
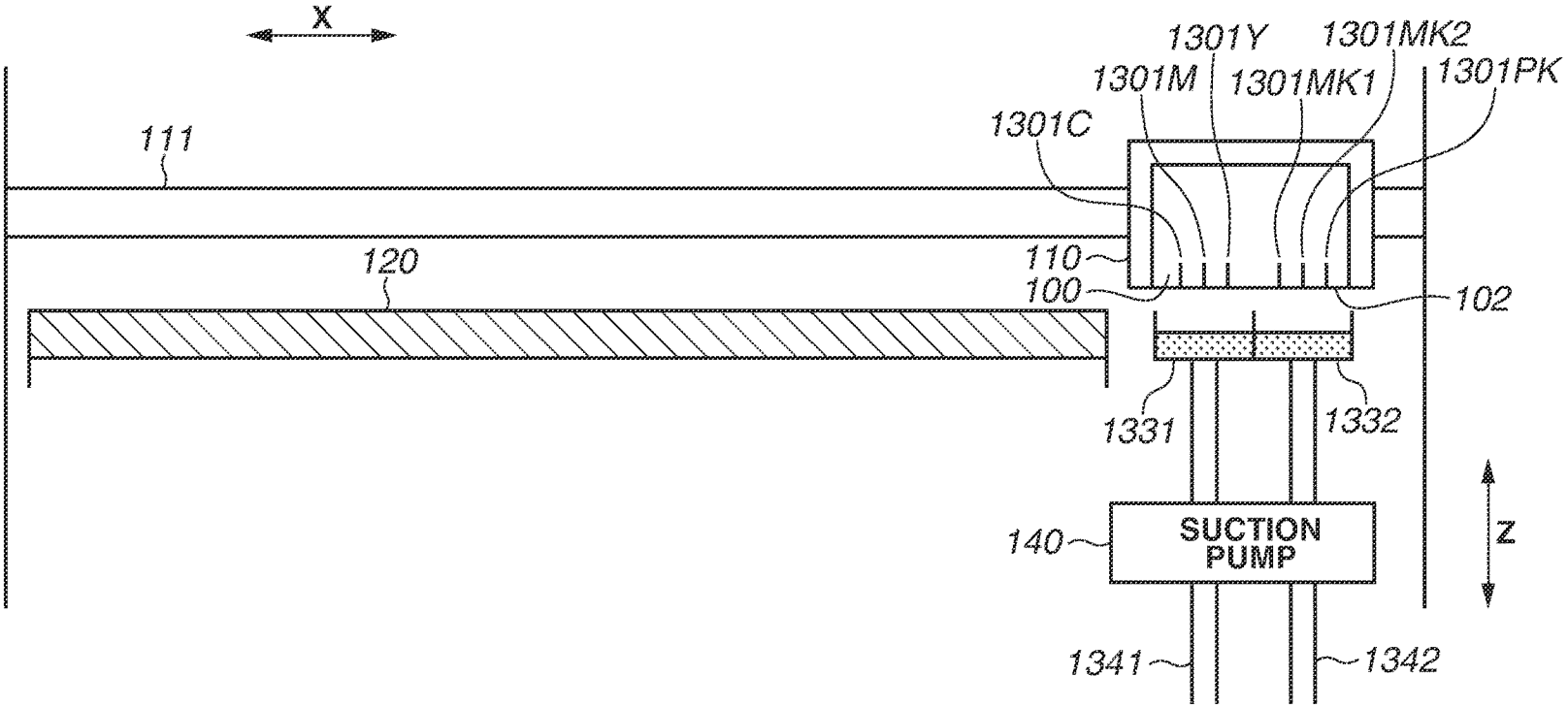
FIG. 13 is a schematic cross-sectional view illustrating one example of an inkjet recording apparatus according to a fourth exemplary embodiment.

A fourth exemplary embodiment of the present disclosure will be described below in detail. FIG. 13 illustrates a schematic cross-sectional view (main portions) of an inkjet recording apparatus according to the present exemplary embodiment. In FIG. 13, components labeled the same reference numerals as those in FIG. 1, 6, or 10 indicate similar elements thereto, and therefore descriptions thereof will be omitted.

The recording head 100 includes ink ejection port arrays 1301C, 1301M, 1301Y, 1301MK1, 1301MK2, and 1301PK that eject ink, on the ink ejection port surface 102. The ink ejection port array 1301C ejects the cyan ink. The ink ejection port array 1301M ejects the magenta ink. The ink ejection port array 1301Y ejects the yellow ink. The ink ejection port arrays 1301MK1 and 1301MK2 each eject the matte black ink. The ink ejection port array 1301PK ejects the photo black ink. In other words, the recording head 100 according to the present exemplary embodiment includes six ink ejection port arrays corresponding to five kinds (five colors) of ink. Assume that a configuration other than that is similar to the first exemplary embodiment.

In FIG. 13, a cap 1331 is a cap for capping the ink ejection port arrays 1301C, 1301M, and 1301Y. A cap 1332 is a cap for capping the ink ejection port arrays 1301MK1, 1301MK2, and 1301PK. These two caps 1331 and 1332 reciprocate in the Z direction in FIG. 13 between capping positions and separation positions with mechanisms (not illustrated) connected to the same driving source, respectively.

The cap 1331 is connected to the suction pump 140 via a first pump tube 1341, and the cap 1332 is connected to the suction pump 140 via a second pump tube 1342. The tube pump is used for the suction pump 140, and causes the ink to be sucked and discharged from each of the ink ejection port arrays by rotating a rotor (not illustrated) when the caps 1331 and 1332 are located at the respective capping positions. By the driving of the suction pump 140, each of the cyan ink, the magenta ink, and the yellow ink is sucked and discharged via the cap 1331, and each of the matte black ink and the photo black ink is sucked and discharged via the cap 1332. Further, the caps 1331 and 1332 are each provided with an ink absorber, and the ink sucked and discharged by the driving of the suction pump 140 is contained in a maintenance cartridge (not illustrated). FIG. 13 illustrates the inkjet recording apparatus when the caps 1331 and 1332 are located at the respective separation positions.

Ink supply systems are in communication with the individual ink ejection port arrays, but descriptions will be omitted for ink supply systems in communication with the ink ejection port arrays that eject the respective colors of ink of the cyan, the magenta, the yellow, and the photo black, assuming that these ink supply systems are similar to that in FIG. 7 described in the second exemplary embodiment. Further, a description will also be omitted here for an ink supply system in communication with the ink ejection port arrays 1301MK1 and 1301MK2 that eject the matte black ink, assuming that this ink supply system is similar to that in FIG. 8 described in the second exemplary embodiment. Further, a description will also be omitted for a control system of the inkjet recording apparatus, assuming that this control system is similar to that in FIG. 3 described in the first exemplary embodiment.

Figure 9:
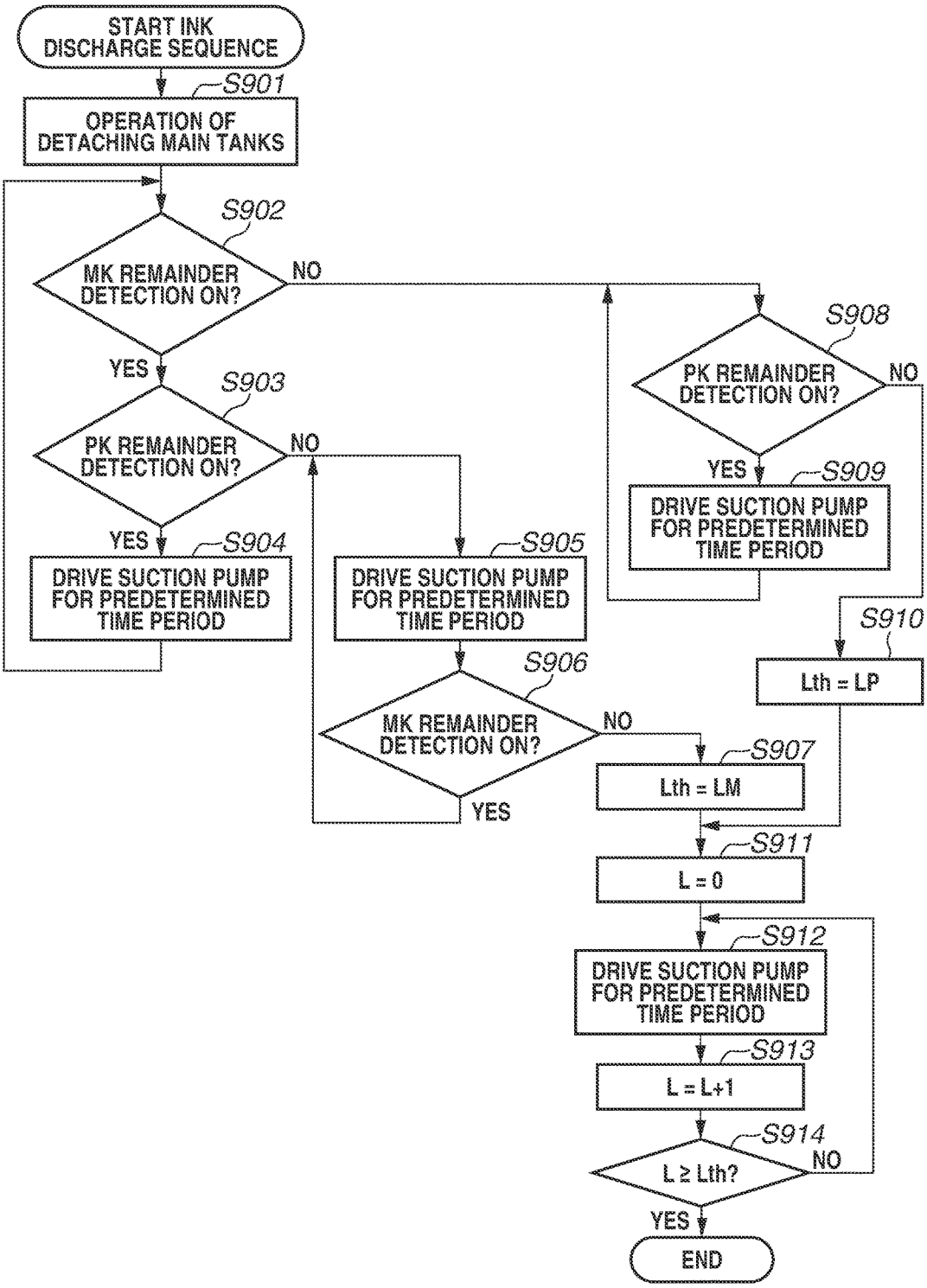
FIG. 9 is a flowchart illustrating an ink discharge sequence according to the second exemplary embodiment.
Figure 11:
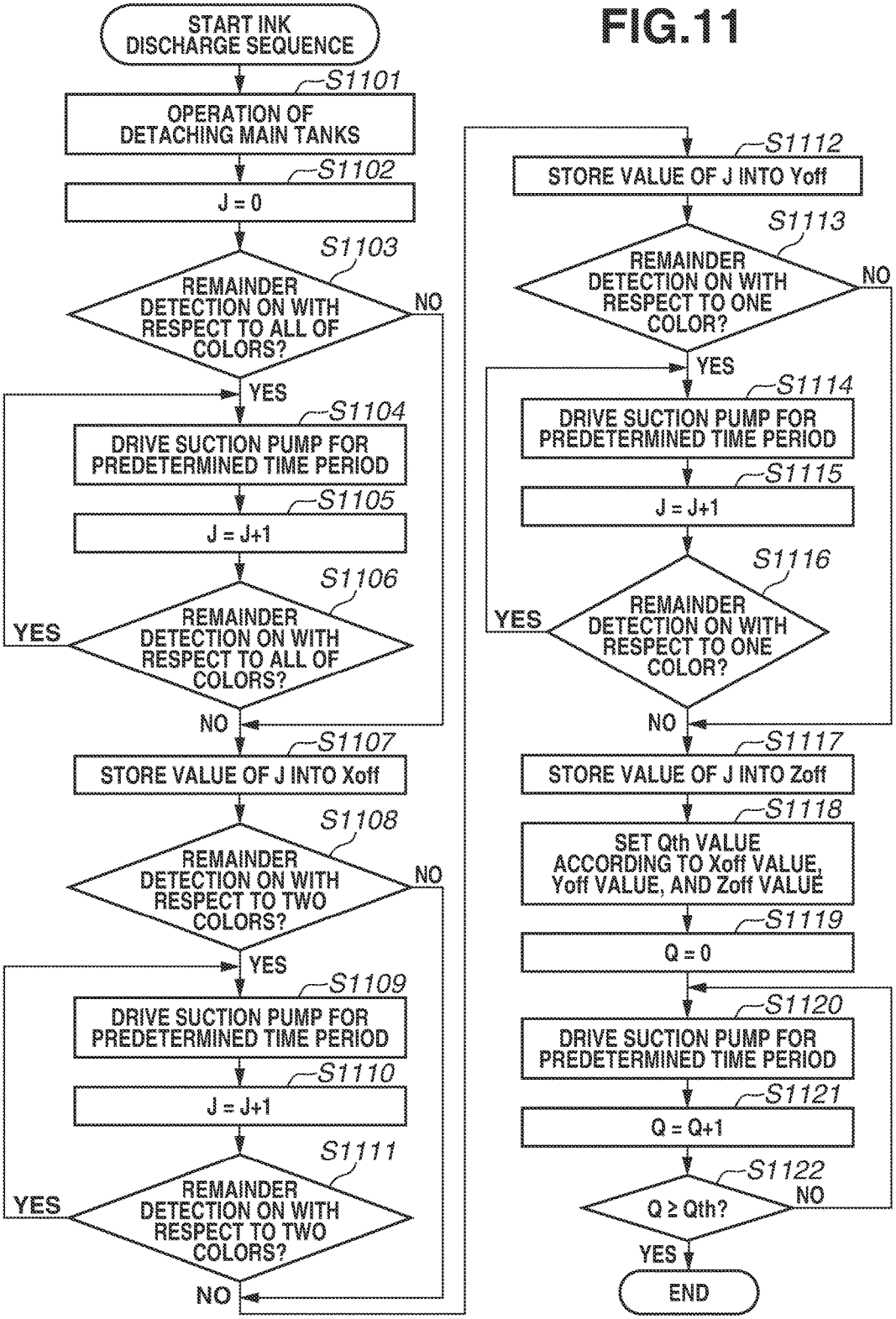
FIG. 11 is a flowchart illustrating an ink discharge sequence according to the third exemplary embodiment.

A sequence constructed by combining the flowcharts illustrated in FIGS. 9 and 11 is performed on the inkjet recording apparatus configured as illustrated in FIG. 13. More specifically, the sequence illustrated in FIG. 9 is used for the cap 1332, and the sequence illustrated in FIG. 11 is used for the cap 1331. Then, the sequence according to the present exemplary embodiment can be completed with an end of the suction operation performed by the suction pump 140 lasting for the predetermined time period in any one of the sequences for the caps 1332 and 1331 that is ended later than the other.

In this manner, the ink can also be sucked and discharged by the substantially entire amount from the ink supply system of the inkjet recording apparatus illustrated in FIG. 13 without spending a long time.

Other Exemplary Embodiments

In the first to fourth exemplary embodiments, the number of times that the driving of the pump lasting for the predetermined time period is repeated after the remainder detection OFF is detected for the last time, which is recorded in an ink remainder detection result history with respect to the plurality of ink tanks and sub tanks, is controlled according to the ink remainder detection result history. In other words, a time period during which the pump is driven from a last detection timing at which the remainder detection OFF is detected for the last time until a discharge operation end timing at which the pump driving is ended, which is recorded in the ink remainder detection result history with respect to a plurality of ink storage units, is controlled according to the ink remainder detection result history. However, embodiments of the present disclosure are not limited to this configuration. For example, as another method for controlling the operation condition (the strength) of the suction operation by the pump, the inkjet recording apparatus may be configured to control a driving capability of the pump from the last detection timing until the discharge operation end timing according to the ink remainder detection result history. One example in this case is controlling a rotational speed of the rotor of the tube pump.

In the first to fourth exemplary embodiments, the suction-type pump is used to cause the ink and/or the atmosphere to be discharged from the ink ejection port array. However, the method for discharging the ink is not limited thereto, and, for example, the inkjet recording apparatus may be configured to cause the ink and/or the atmosphere to be pressurized and discharged from the ink storage unit side with use of a pressurizing pump.

In the first to fourth exemplary embodiments, the exemplary embodiments of the present disclosure have been described citing the example in which the recording head based on a thermal inkjet method is used. However, embodiments of the present disclosure are also effective even in a case where a recording head based on another method, such as a piezoelectric method, is employed.

In the first to fourth exemplary embodiments, the exemplary embodiments of the present disclosure have been described citing the example in which the inkjet recording apparatus is a serial scan-type inkjet recording method, which causes the recording head mounted on the carriage to scan in the X direction in FIG. 1, but embodiments of the present disclosure are not limited to such an example. Aspects of the present disclosure are also effective for, for example, a full line-type inkjet recording apparatus, which fixedly arranges a full line-type recording head longer than a length of a direction perpendicular to a direction in which the medium is conveyed, and ejects the ink onto the medium while the medium is being conveyed.

In the first to fourth exemplary embodiments, the ink tank and the sub tank are disposed fixedly relative to the inkjet recording apparatus, but the present disclosure is also effective for such an inkjet recording apparatus that the ink tank and/or the sub tank are/is arranged on a carriage.

Embodiments of the present disclosure can also be realized by processing that supplies a program capable of realizing one or more function(s) of the above-described exemplary embodiments to a system or an apparatus via a network or a storage medium, and causes one or more processor(s) of a computer of this system or apparatus to read out and execute the program. Further, embodiments of the present disclosure can also be realized by a circuit (e.g., an application specific integrated circuit (ASIC)) capable of realizing one or more function(s).

As described above, the inkjet recording apparatus enables the ink to be discharged from the inkjet recording apparatus without requiring the trained person, such as the serviceperson, and without spending the long time.

While aspects of the present disclosure have been described with reference to exemplary embodiments, it is to be understood that the embodiments of the disclosure are not limited to the disclosed exemplary embodiments. The scope of the following claims is to be accorded the broadest interpretation so as to encompass all such modifications and equivalent structures and functions.

This application claims the benefit of priority of Japanese Patent Application No. 2017-046507, filed Mar. 10, 2017, which is hereby incorporated by reference herein in its entirety.

What is claimed is:

1. An inkjet recording apparatus comprising:

a recording unit including a first ink ejection port array and a second ink ejection port array;

a first ink storage unit configured to store ink to be supplied to the first ink ejection port array;

a second ink storage unit configured to store ink to be supplied to the second ink ejection port array;

a discharge unit configured to perform a discharge operation of discharging at least one of the ink and air from the first ink ejection port array and the second ink ejection port array for a predetermined time;

a first detection unit configured to detect that an amount of the ink stored in the first ink storage unit is below a first predetermined amount;

a second detection unit configured to detect that an amount of the ink stored in the second ink storage unit is below a second predetermined amount;

a control unit configured to control the discharge unit to perform the discharge operation until the first detection unit detects that the amount of the first ink is below the first predetermined amount and the second detection unit detects that the amount of the second ink is below the second predetermined amount;

a first counter configured to count, as a first number of times, how many times the discharge operation is performed until the first detection unit detects that the amount of the first ink is below the first predetermined amount; and a second counter configured to count, as a second number of times, how many times the discharge operation is performed until the second detection unit detects that the amount of the second ink is below the second predetermined amount, wherein the control unit controls the discharge unit to perform the discharge operation a determined number of times based on the first number and the second number.

2. The inkjet recording apparatus according to claim 1, wherein the recording unit includes a third ink ejection port array in communication with the first ink storage unit.

3. The inkjet recording apparatus according to claim 1, wherein the discharge unit includes a cap configured to cover the first ink ejection port array and the second ink ejection port array, and a suction pump configured to generate a negative pressure inside the cap.

4. The inkjet recording apparatus according to claim 1, wherein the control unit controls the discharge unit to perform the discharge operation a first determined number of times in a case where a difference between the first number and the second number is larger than a predetermined value and to perform the discharge operation a second determined number of times less than the first determined number of times in a case where the difference is smaller than the predetermined value.

5. The inkjet recording apparatus according to claim 1, further comprising:

a first tube configured to connect the first ink storage unit and the recording unit; and a second tube configured to connect the second ink storage unit and the recording unit.

6. The inkjet recording apparatus according to claim 1, further comprising:

a first tank detachably attached to the apparatus and configured to store the first ink to be supplied to the first ink storage unit;

a second tank detachably attached to the apparatus and configured to store the second ink to be supplied to the second ink storage unit.

7. The inkjet recording apparatus according to claim 6, wherein the discharge unit starts to perform the discharge operation after the first tank and the second tank are detached from the apparatus.

8. An ink discharge method in an inkjet recording apparatus, the inkjet recording apparatus including a recording unit including a first ink ejection port array and a second ink ejection port array, a first ink storage unit configured to store ink to be supplied to the first ink ejection port array, and a second ink storage unit configured to store ink to be supplied to the second ink ejection port array, the ink discharge method comprising:

performing a discharge operation of discharging at least one of the ink and air from the first ink ejection port array and the second ink ejection port array for a predetermined time;

carrying out first detection of detecting that an amount of the first ink stored in the first ink storage unit is below a first predetermined amount;

carrying out second detection of detecting that an amount of the second ink stored in the second ink storage unit is below a second predetermined amount; and continuing the discharge operation until the first detection unit detects that the amount of the first ink is below the first predetermined amount and the second detection unit detects that the amount of the second ink is below the second predetermined amount;

counting, as a first number of times, how many times the discharge operation is performed until it is detected in the first detection that the amount of the first ink is below the first predetermined amount;

counting, as a second number of times, how many times the discharge operation is performed until it is detected in the second detection that the amount of the second ink is below the second predetermined amount; and performing the discharge operation a determined number of times based on the first number and the second number.

* * * * *